US006541912B1

(12) United States Patent
Fritz et al.

(10) Patent No.: US 6,541,912 B1
(45) Date of Patent: Apr. 1, 2003

(54) AUXILIARY CHAMBER AND DISPLAY DEVICE WITH IMPROVED CONTAMINANT REMOVAL

(75) Inventors: William C. Fritz, Menlo Park, CA (US); Igor L. Maslennikov, Sunnyvale, CA (US); Robert M. Duboc, Jr., Menlo Park, CA (US); Theodore S. Fahlen, San Jose, CA (US); George B. Hopple, Palo Alto, CA (US); Christopher J. Curtin, San Jose, CA (US); Colin D. Stanners, San Jose, CA (US); Petre H. Vatahov, San Jose, CA (US); Christopher J. Spindt, Menlo Park, CA (US); Ronald L. Hansen, San Jose, CA (US)

(73) Assignee: Candescent Technologies Corporation, San Jose, CA (US)

( * ) Notice: Subject to any disclaimer, the term of this patent is extended or adjusted under 35 U.S.C. 154(b) by 0 days.

(21) Appl. No.: 09/361,334

(22) Filed: Jul. 26, 1999

Related U.S. Application Data

(63) Continuation-in-part of application No. 09/196,626, filed on Nov. 18, 1998, now Pat. No. 6,147,450.

(51) Int. Cl.[7] ..... H01J 17/24

(52) U.S. Cl. ..... 313/553; 313/495; 313/422; 417/48; 417/51

(58) Field of Search ..... 313/553, 561, 313/563, 549, 551, 481, 422, 495; 417/48, 51

(56) References Cited

U.S. PATENT DOCUMENTS

| | | | | |
|---|---|---|---|---|
| 5,514,847 A | | 5/1996 | Makishima et al. | 219/121.12 |
| 5,548,181 A | | 8/1996 | Jones | 313/309 |
| 5,635,795 A | * | 6/1997 | Itoh et al. | 313/496 |
| 5,656,889 A | | 8/1997 | Niiyama et al. | 313/553 |
| 5,688,708 A | | 11/1997 | Kato et al. | 437/51 |
| 5,909,202 A | | 6/1999 | Cathey | 345/74 |
| 5,977,706 A | * | 11/1999 | Cho et al. | 313/553 |
| 6,147,450 A | * | 11/2000 | Fritz et al. | 313/495 |

* cited by examiner

*Primary Examiner*—Vip Patel
*Assistant Examiner*—Joseph Williams
(74) *Attorney, Agent, or Firm*—Wagner, Murabito & Hao LLP

(57) ABSTRACT

An apparatus for removing contaminants from a display device is disclosed. In one embodiment, an auxiliary chamber is adapted to be coupled to a surface of a display device such that contaminants within the display device can travel from the display device into the auxiliary chamber. A getter is disposed in the auxiliary chamber. The getter is adapted to capture the contaminants once the contaminants travel from the display device into the auxiliary chamber. In other embodiments, the getter is disposed in the border region surrounding the active area of the display.

63 Claims, 43 Drawing Sheets

AUXILIARY CHAMBER AND DISPLAY DEVICE WITH IMPROVED CONTAMINANT REMOVAL

This application is a continuation-in-part of and claims the benefit of U.S. Non-Provisional application Ser. No. 09/196,626 filing date Nov. 18, 1998, now U.S. Pat. No. 6,147,450.

FIELD OF THE INVENTION

The present claimed invention relates to the field of flat panel displays. More particularly, the present claimed invention relates to an auxiliary chamber and display device with improved contaminant removal.

BACKGROUND ART

Display devices such as, for example, flat panel display devices typically utilize an evacuated environment during operation. In a field emission-type display device, field emitters located on a cathode emit electrons which are directed towards respective pixel or sub-pixel regions on a faceplate. In such a device, it is imperative that the region between the faceplate and the cathode (i.e. the active environment) remain free of contaminants so that the electrons can travel unimpeded from the cathode to the faceplate. As yet another concern, if certain contaminants are present in the active environment between the cathode and the faceplate, certain features, such as the field emitters may be damaged.

With reference now to Prior Art FIG. 1, a side sectional view of a display device 100 employing a conventional contaminant reduction approach is shown. Specifically, Prior Art FIG. 1 shows a backplate or cathode 102 secured to a faceplate 104 via a sealing frame 106. The active environment is the region located between cathode 102 and faceplate 104. Field emitters, typically shown as 108, are coupled to cathode 102 and are disposed within the active environment. In the conventional approach of Prior Art FIG. 1, a getter material 110 is also coupled to the cathode and is disposed within the active environment. The getter material is intended to capture contaminant particles which remain in the active environment after an evacuation process. The getter material is also intended to capture contaminant particles which are generated during operation of display device 100.

Unfortunately, the conventional approach of Prior Art FIG. 1 has significant drawbacks associated therewith. By locating getter material 110 within the active environment, region 112 is no longer available for use. That is, such a prior art approach reduces or compromises the amount of space which is available to be utilized by features such as, for example, field emitters. Additionally, by placing getter material 110 within the active environment, such a prior art approach deleteriously subjects the active environment, and hence field emitters 108, to the hazardous getter material 110. As a result, field emitters 108 are often degraded or damaged due to their close proximity to getter material 110.

With reference now to Prior Art FIG. 2, a side sectional view of display device 100 employing another conventional approach in an attempt to reduce contaminants is shown. In this approach a pump-out tube is coupled directly to the active environment. The pump-out tube is used to facilitate evacuation of display device 100, and, hence, remove contaminants therefrom. Once again, such a conventional approach has severe drawbacks associated therewith. Attaching tubulation directly to the active environment of display device 100 greatly complicates the process of manufacturing display device 100. Additionally, the increased complexity associated with attaching the tubulation directly to display device 100 adds additional cost to the manufacturing process. Furthermore, the potential for defects in display device 100 is heightened by attaching tubulation 114 directly to display device 100.

Referring still to Prior Art FIG. 2, conventional tubulation such as tubulation 114 significantly alters and increase the "envelope" of display device 100. The envelope of display device 100 refers roughly to the amount of space occupied by the display device 100. In Prior Art FIG. 2, the envelope of display device 100 is shown by dotted line 116. As a result of protruding tubulation 114, display device 100 must be allotted a larger area in which to operate. It will be seen from Prior Art FIG. 2, that the increased area or envelope 116 required by tubulation 114 may restrict or limit the locations and environments in which display device 100 can be used.

With reference next to Prior Art FIG. 3, a side sectional view of display device 100 employing another conventional approach in an attempt to reduce contaminants is shown. In this conventional approach, tubulation 118 is again attached directly to the active environment of display device 100. As still another drawback, tubulation 118 extends beyond the edge of display device. As result, prior art tubulation 118 often interferes with the sealing process used to secure cathode 102 and faceplate 104 together. More specifically, during a laser sealing process, for example, the laser beam or beams must contact the entire periphery of display device 100. In the configuration shown in Prior Art FIG. 3, tubulation 118 can obstruct the laser beam or beams, thereby "shadowing" a portion of the periphery of display device 100. As a result, the seal between cathode 102 and faceplate 104 can be compromised, or the sealing process must be altered to accommodate tubulation 118.

Thus, a need exists for an apparatus which removes contaminants from a display device without compromising the usable amount of space available within the display device. A further need exists for an auxiliary chamber which meets the above listed needs but which does not deleteriously expose features of the display device to getter material. Still another need exists for an auxiliary chamber which meets the above-listed needs but which does not significantly increase or alter the overall dimensions of the display device. Still another need exists for an apparatus that has improved contaminant particle removal.

SUMMARY OF INVENTION

The present invention provides an apparatus which removes contaminants from a display device without compromising the usable amount of space available within the display device. The present invention also provides an auxiliary chamber which realizes the above listed accomplishment and which does not deleteriously expose features of the display device to getter material. The present invention further provides an auxiliary chamber which achieves the above-listed accomplishments but which does not significantly increase or alter the overall dimensions of the display device. The present invention also provides an apparatus with improved contaminant particle removal.

Specifically, the present invention provides an apparatus for removing contaminants from a display device using an auxiliary chamber, and a method for attaching the auxiliary chamber to the display device. In one embodiment, an auxiliary chamber is adapted to be coupled to a surface of a display device. The auxiliary chamber is adapted to be coupled to the surface of the display device such that contaminants within the display device can travel from the display device into the auxiliary chamber. The auxiliary chamber further includes a getter which is disposed therein. The getter is adapted to capture the contaminants once the contaminants travel from the display device into the auxiliary chamber. In so doing, the present invention eliminates the need for getter material to be placed within the active area of the display device. As a result, the present invention increases the usable amount of space available within the display device. This extra space can then be utilized by features such as, for example, additional field emitters.

In another embodiment, the present invention provides method for attaching an auxiliary chamber to a display device. In this embodiment, the present invention first conditions a surface of a display device such that a conditioned surface of the display device is generated. This conditioned surface of the display device is thereby adapted to have an auxiliary chamber bonded thereto. Next, the present invention conditions a surface of the auxiliary chamber such that a conditioned surface of the auxiliary chamber is generated. In so doing, the conditioned surface of the auxiliary chamber is adapted to be bonded to the conditioned surface of the display device. After the conditioning steps, the present invention bonds the conditioned surface of the auxiliary chamber to the conditioned surface of the display device.

In yet another embodiment, an auxiliary chamber is disclosed that includes a cylindrical housing. Cylindrical rings of non evaporable getter material are disposed within the cylindrical housing around a centrally disposed conductive element. In another embodiment, an auxiliary chamber is disclosed that houses a barium flash bulb.

The present invention also provides various apparatus that provide for improved contaminant particle removal. In one embodiment, improved particle removal is accomplished using a metal film that forms a surface having low thermal emissivity. In another embodiment, a carbon felt structure is used to achieve improved contaminant particle removal. In yet another embodiment, a pre-flashed getter capsule is used. Another embodiment discloses the use of RF coils for selectively activating getter material. In still another embodiment, various configurations of a planar evaporable getter are used.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

PRIOR ART

PRIOR ART

PRIOR ART

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 4:
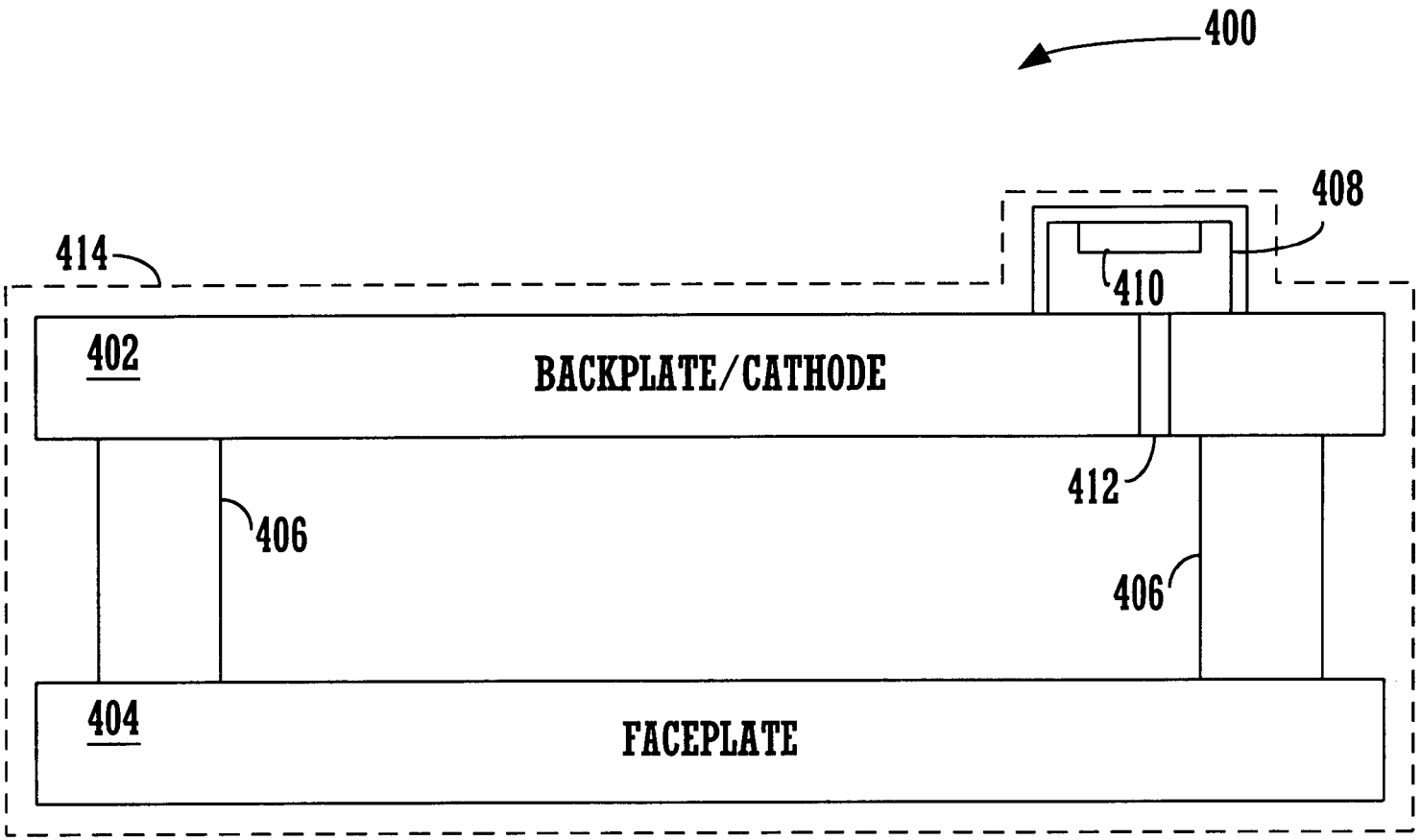
FIG. 4 is a side sectional view of a display device having an auxiliary chamber coupled thereto in accordance with one embodiment of the present claimed invention.

With reference now to FIG. 4, a side sectional view of a display device 400 having an auxiliary chamber 408 coupled thereto is shown. In the present embodiment, a backplate/cathode 402 is secured to a faceplate 404 using a sealing frame 406. Although a sealing frame is recited in the present embodiment, the present invention is also well suited to embodiments employing any of numerous methods and devices to secure cathode 402 and faceplate 404 together. Additionally, display device 400 of the present is a flat panel display device, however, the present invention is well suited for use in any device in which contaminant reduction or containment is desired. Furthermore, display device 400 of the present embodiment may contain numerous features such as, for example, field emitters, pixel regions, spacer structures, and the like, which are not shown in FIG. 4 for purposes of clarity. Also, in the present embodiment, auxiliary chamber 408 is coupled to backplate/cathode 402 of display device 400. The present invention is, however, also well suited to an embodiment in which auxiliary chamber 408 is coupled to a portion of display device 400 other than backplate/cathode 402.

Referring still to FIG. 4, an auxiliary chamber 408 is shown coupled to a surface of display device 400 in accordance with the present claimed invention. More particularly, in the embodiment of FIG. 4, auxiliary chamber 408 is coupled to the outer surface of cathode 402. Auxiliary chamber 408 of the present embodiment has a getter 410 disposed therein. Also, in the present embodiment, auxiliary chamber 408 is disposed above small openings, typically shown as 412. Openings 412 extend completely through the surface of cathode 402 to the active environment of display device 400. By placing auxiliary chamber 408 above small openings 412, contaminants within the active environment of display device 400 can travel through openings 412, into auxiliary chamber 408, and be captured by getter 410.

Figure 5:
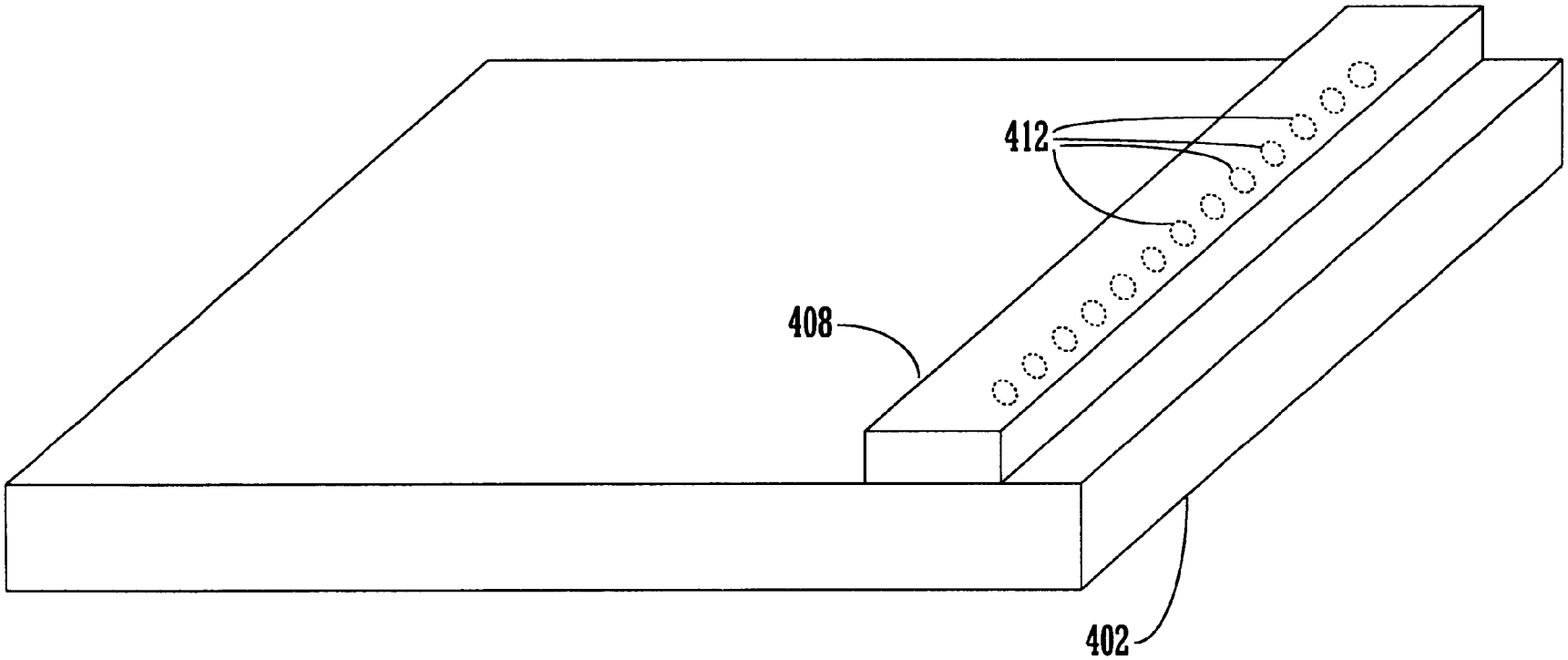
FIG. 5 is a perspective view of the embodiment of FIG. 4 in accordance with one embodiment of the present claimed invention.

With reference now to FIG. 5, a perspective view of the present embodiment is shown. In the present embodiment, auxiliary chamber 408 extends across the entire length of cathode 402 (i.e. one side to another side of cathode 402), and auxiliary chamber is disposed above a plurality of holes 412 which extend through cathode 402. Although such a configuration is shown in the present embodiment, the present invention is also well suited to various other configurations. Alternate configurations include, for example, configuring auxiliary chamber 408 to extend only partially across the surface of cathode 402, configuring auxiliary chamber 408 to cover a larger portion of the surface of cathode 402, configuring auxiliary chamber 408 to cover a smaller portion of the surface of cathode 402, and the like. Additionally, the present invention is also well suited to an embodiment in which a plurality of auxiliary chambers are coupled to cathode 402.

Figure 1:
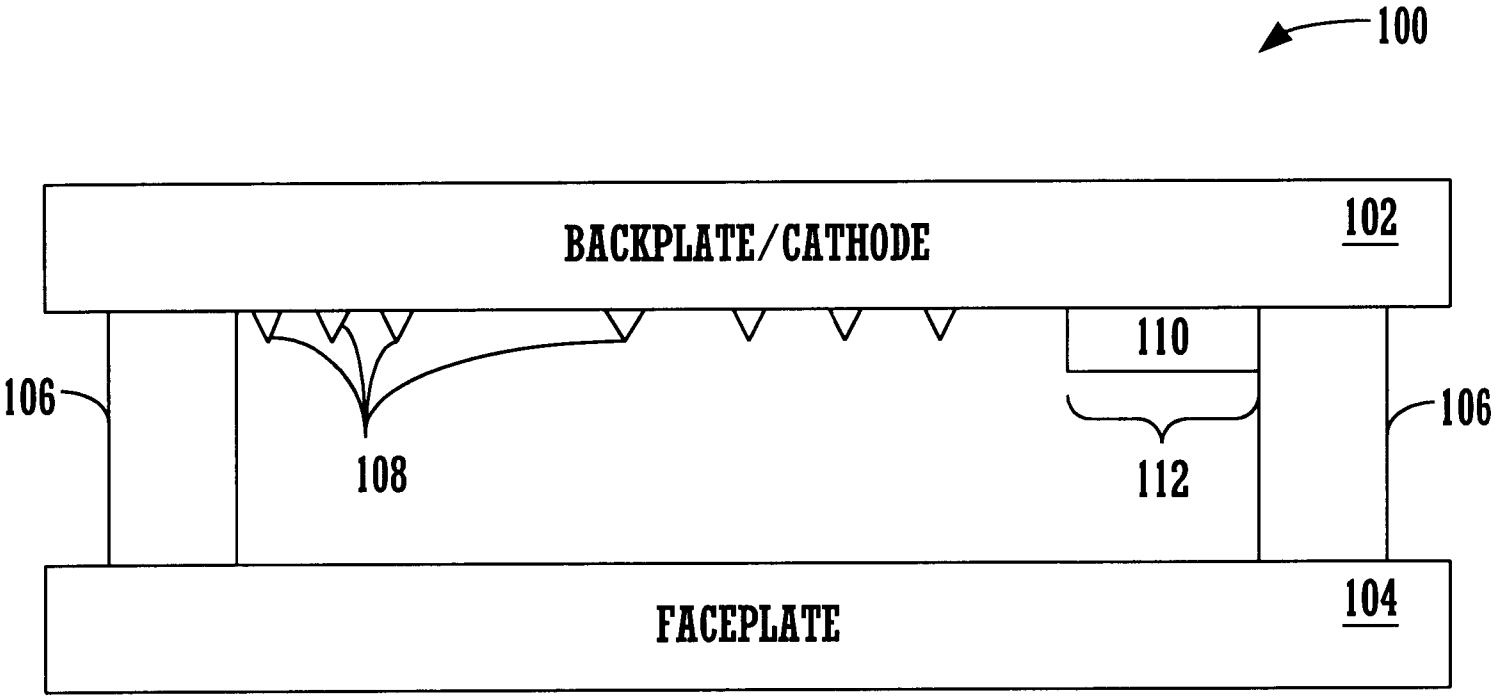
FIGURE 1 (Prior Art)
FIG. 1 is a side sectional view of a display device employing a conventional contaminant reduction approach.
Figure 2:
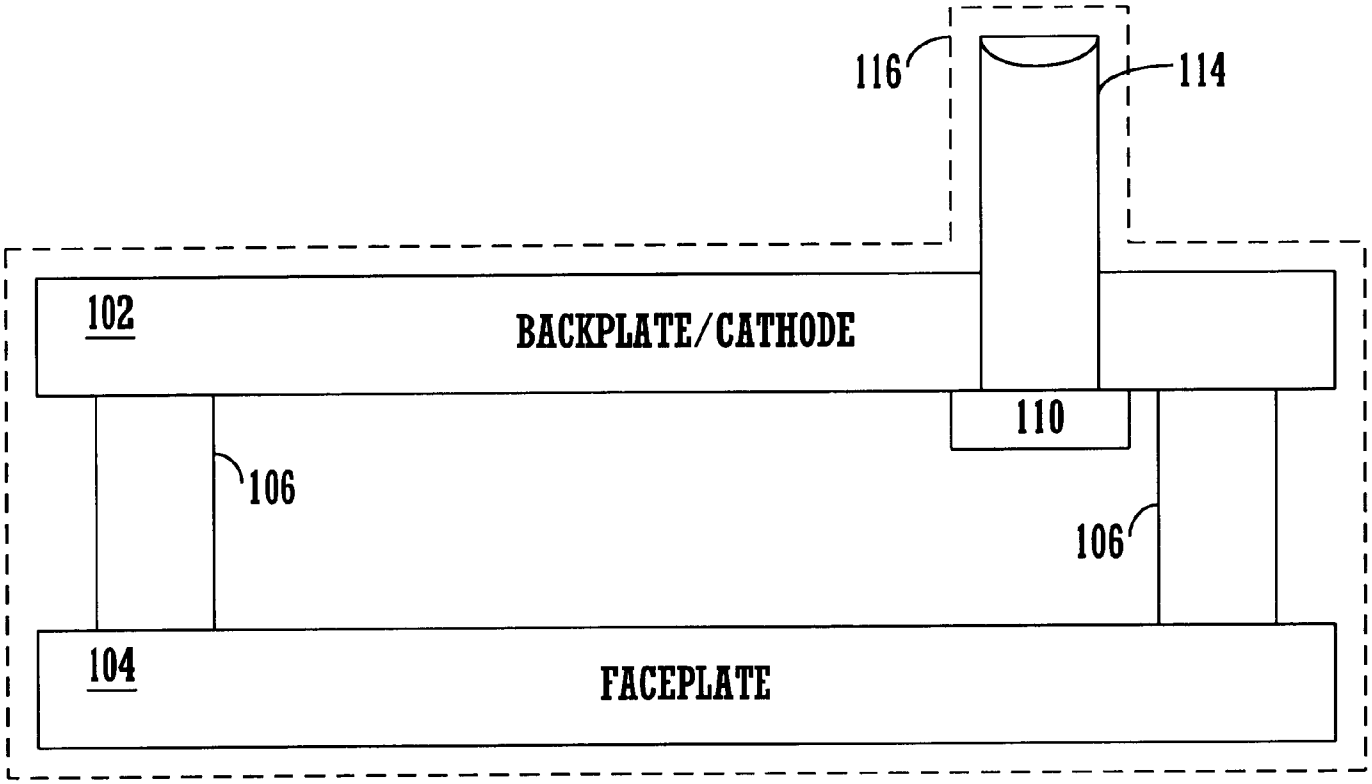
FIGURE 2 (Prior Art)
FIG. 2 is a side sectional view of a display device employing another approach used in an attempt to reduce contaminants.

With reference again to FIG. 4, auxiliary chamber 408 of the present embodiment has an extremely low profile. That is, unlike prior art devices (see e.g. device 114 of Prior Art FIG. 2), auxiliary chamber 408 of the present embodiment does not significantly increase or alter the overall dimensions of display device 400. Thus, the "envelope" of display device 400 (shown by dotted line 116) is not significantly affected by the addition of auxiliary chamber 408. Therefore, unlike many conventional devices, auxiliary chamber 408 does not restrict or limit the locations and environments in which display device 400 can be used.

In the present embodiment, auxiliary chamber 408 is formed of any of various materials or combinations of material. In one embodiment, auxiliary chamber 408 is formed of glass. In another embodiment of the present invention auxiliary chamber 408 is formed of ceramic material such as, for example, alumina. Although these specific materials are recited herein, the present invention is well suited to forming auxiliary chamber out of various other materials such as metals, composites, plastics, and the like. The embodiment formed of ceramic material has several advantages associated therewith. For instance, in one embodiment when using ceramic material, auxiliary chamber 408 is formed using an extrusion process. In another embodiment when using ceramic material, auxiliary chamber 408 is formed using a molding process. In still another embodiment when using ceramic material, auxiliary chamber 408 is formed using a pressing process. In yet another embodiment when using ceramic material, auxiliary chamber 408 is formed using a lamination process. These aforementioned fabrication process greatly simplify the task of forming auxiliary chamber 408, reduce costs associated with fabricating auxiliary chamber 408, and improve the robustness of auxiliary chamber 408. Additionally, heat distribution is improved in an embodiment in which auxiliary chamber is formed of ceramic material. This improved heat distribution is particularly advantageous during a getter activation process to be described in detail below. Specifically, by readily and evenly distributing heat, a ceramic auxiliary chamber 408 is not subject to severe heat induced stresses which can occur during, for example, getter activation. Because the present invention includes both ceramic and non-ceramic embodiments, the following discussion will pertain to both the ceramic and the non-ceramic embodiments unless specifically noted otherwise.

With reference still to FIG. 4, the present embodiment disposes getter 410 within auxiliary chamber 408. Unlike conventional approaches, by locating getter 410 within auxiliary chamber, the present embodiment does not reduce or compromise the amount of space within the active environment which is available to be utilized by features such as, for example, field emitters. Furthermore, by placing getter 410 within auxiliary chamber 408, the present embodiment does not deleteriously subject the active environment, and hence the field emitters, to the hazardous getter 410. Although such an arrangement is recited in the present embodiment, the present invention is also well suited to an embodiment in which additional getter is disposed within or proximate to the active environment of display device 400.

In one embodiment, getter 410 is comprised of evaporable getter such as, for example, barium, titanium, and the like. In another embodiment, getter 410 is comprised of a non-evaporable getter. In one embodiment, getter 410 includes barium rings. In still another embodiment, getter 410 is comprised of a combination of evaporable getter and non-evaporable getter. It will be understood that in certain embodiments of the present invention getter 410 must be activated. The present invention is well suited to accommodating any of the various getter activation processes well known in the art.

Figure 6A:
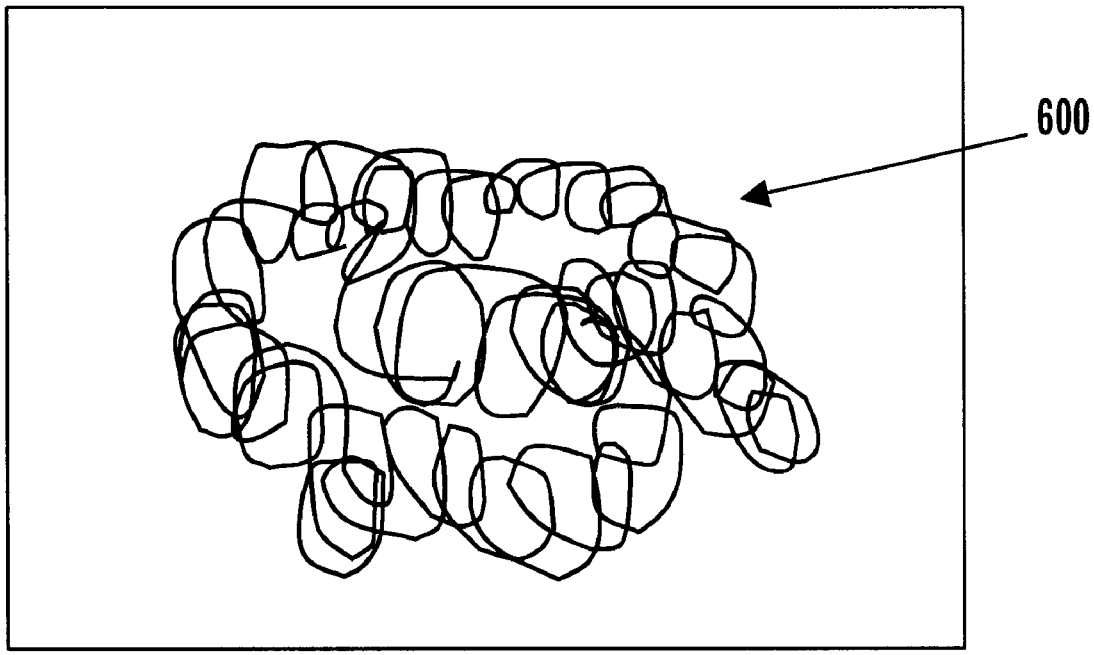
FIG. 6A is a schematic representation of getter material disposed on a bundled filament in accordance with one embodiment of the present claimed invention.

With reference now to FIG. 6A, a schematic representation of getter material disposed on a bundled filament 600 in accordance with one embodiment of the present claimed invention is shown. In this embodiment, getter material such as, for example, barium is coated on a filament. In the present embodiment, bundled filament 600 is comprised of tantalum, however, the present embodiment is also well suited to the use of various other filament materials, such as, for example, titanium, tungsten, a tantalum-titanium alloy, and the like. When exposed to heat, bundled filament 600 disperses or "flashes" or sublimates the getter material coated thereon throughout the interior surface of auxiliary chamber 408. In the present embodiment, bundled filament 600 is exposed to an rf (radio frequency) heating source, a laser heating source, and the like.

Referring still to FIG. 6A, several substantial advantages are realized by the present embodiment. When flashed or heated, bundled filament 600 disperses the getter material widely and evenly throughout the interior surface of auxiliary chamber 408. That is, many prior art approaches "throw" getter mate rial only very near an original source of the getter material. Thus, bundled filament 600 provides a substantial disbursement improvement over conventional getter distribution methods. Bundled filament 600 is also capable of being very long and tortuous, filling the internal space of auxiliary chamber 408, and thereby containing more getter material than current getter source devices provide. Additionally, after the disbursement of the getter material, the filament remains within auxiliary chamber. The filament, along with the interior surface of auxiliary chamber 408 will have getter material dispersed thereon. The presence of the filament increases the surface area which is available to be coated with getter. Thus, gettering capabilities are enhanced in the present embodiment. Also, bundled filament 600 will heat, flash, or sublimate quickly, and distribute the heat evenly throughout the interior region of auxiliary chamber 408, thereby exposing auxiliary chamber 408 and cathode 402 to minimal thermal shock.

As yet another advantage of the embodiment of FIG. 6A, bundled filament 600 can be prepared as a subassembly and then be disposed within auxiliary chamber 408 when desired. This manufacturing flexibility provides a substantial improvement over typical prior art getter sources. Furthermore, because of its extremely low mass (and, hence, minimal heat transfer), bundled filament 600 can be located within auxiliary chamber 408 directly on the surface of cathode 402 and/or directly against the interior surface of auxiliary chamber 408. This versatility in the placement of bundled filament 600 substantially eases the burden of precise getter source mounting associated with conventional getter distribution methods.

Figure 6B:
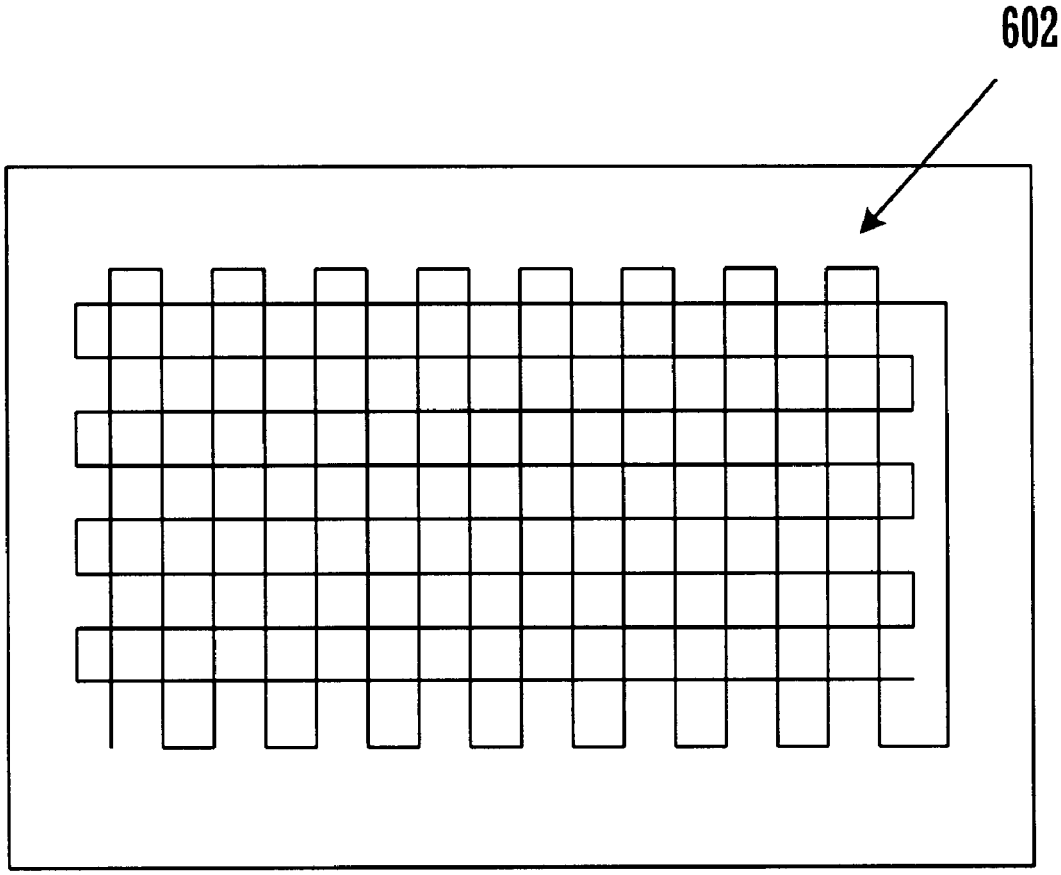
FIG. 6B is a schematic representation of getter material disposed on a filament arranged in a lattice configuration in accordance with one embodiment of the present claimed invention.

Referring now to FIG. 6B, a schematic representation of getter material disposed on a filament arranged in a lattice configuration in accordance with one embodiment of the present claimed invention is shown. The filament is arranged in a lattice configuration to produce a "latticed filament" 602 wherein the various rows and columns of the latticed filament 602 do not contact each other at respective intersections thereof. The present embodiment is formed and functions similarly to the embodiment of FIG. 6A. That is, getter material such as, for example, barium is coated on a filament. In the present embodiment, latticed filament 602 is comprised of tantalum, however, the present embodiment is also well suited to the use of various other filament materials, such as, for example, titanium, tungsten, a tantalum-titanium alloy, and the like. When exposed to heat, latticed filament 602 disperses or "flashes" the getter material coated thereon throughout the interior surface of auxiliary chamber 408. However, in the present embodiment, latticed filament 602 is adapted to be exposed to an electrical current to achieve the desired heating. To insure proper passage of current throughout its entire length, the various rows and columns of latticed filament 602 must not contact each other at respective intersections thereof. Many of the numerous substantial benefits described in conjunction with the embodiment of FIG. 6A apply to the present embodiment as well.

Figure 6C:
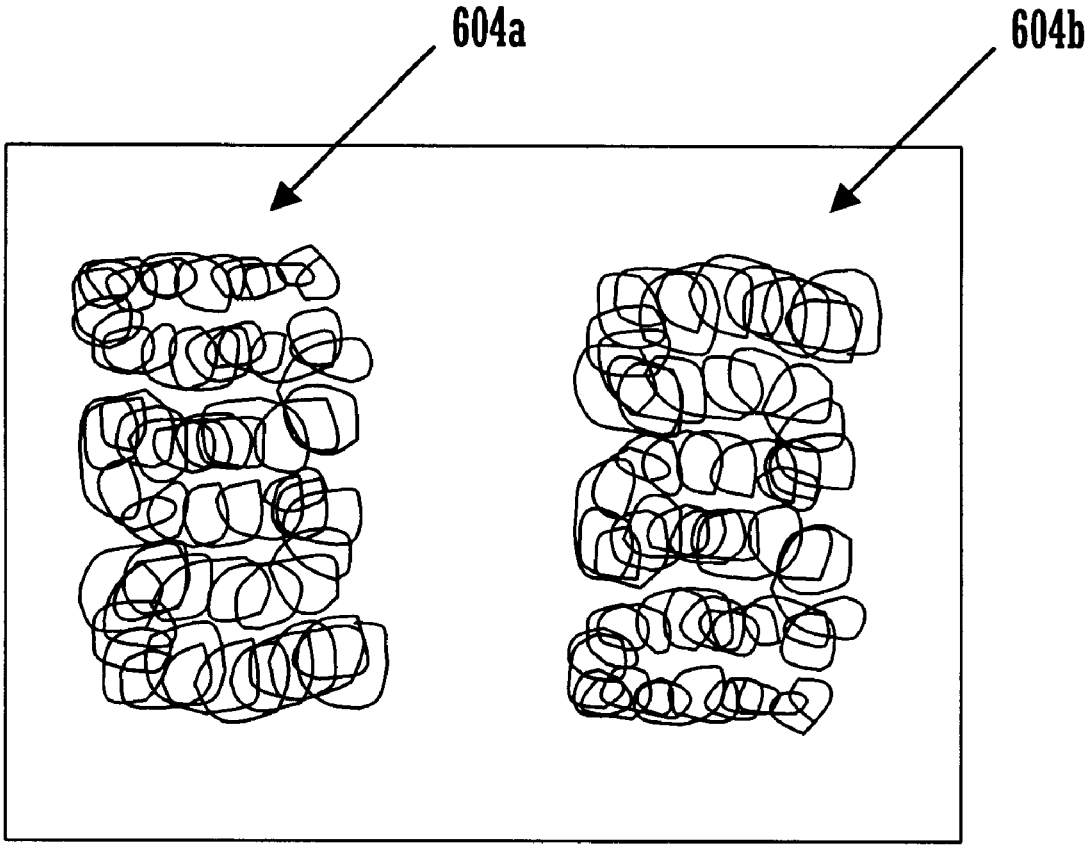
FIG. 6C is a schematic representation of getter material disposed on a plurality of separately bundled filaments in accordance with one embodiment of the present claimed invention.
Figure 6D:
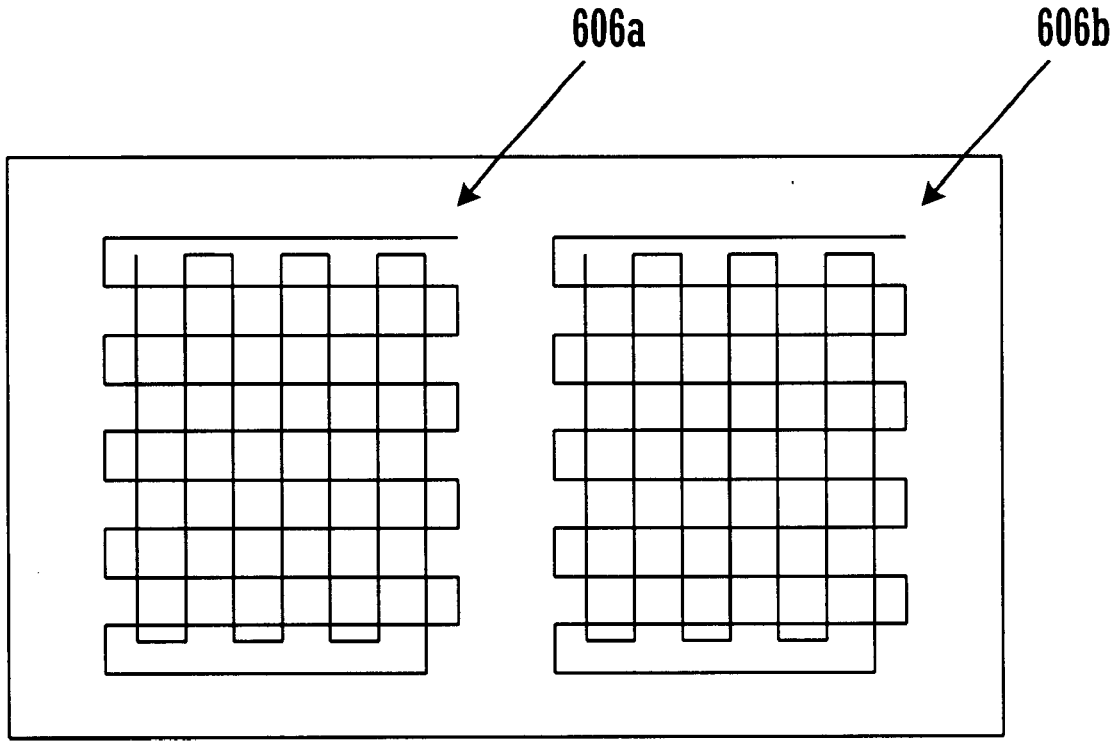
FIG. 6D is a schematic representation of getter material disposed on a plurality of filaments arranged in separate lattice configurations in accordance with one embodiment of the present claimed invention.

FIGS. 6C and 6D are schematic representations of getter material disposed on a plurality of separately bundled filaments 604*a*, 604*b*, 606*a* and 606*b*, in accordance with another embodiment of the present claimed invention. In these embodiments, multiple bundles or lattices of getter coated filaments are disposed within auxiliary chamber 408. In so doing, the distinctly partitioned filaments can be separately activated. For example, a first filament (e.g. 604*a* or 606*a*) can be activated at the factory, and a second filament (e.g. 604*b* or 606*b*) can later be activated in situ. As a result, the getter material is refreshable when desired by the customer. Although specific combination of filaments are shown in FIGS. 6C and 6D, the present invention is well suited to using a greater number of filaments in a given auxiliary chamber, and the present invention is also well suited to having a combination including both bundled and latticed filaments in the same auxiliary chamber.

With reference to FIG. 4, auxiliary chamber 408 of the present embodiment does not have tubulation extending therefrom. That is, auxiliary chamber 408 is, for example, attached to display device 400 in a vacuum environment. In such an embodiment, it may not be necessary to perform any additional evacuating processes. Thus, the present invention is well suited to an embodiment in which auxiliary device 408 does not include tubulation.

Figure 3:
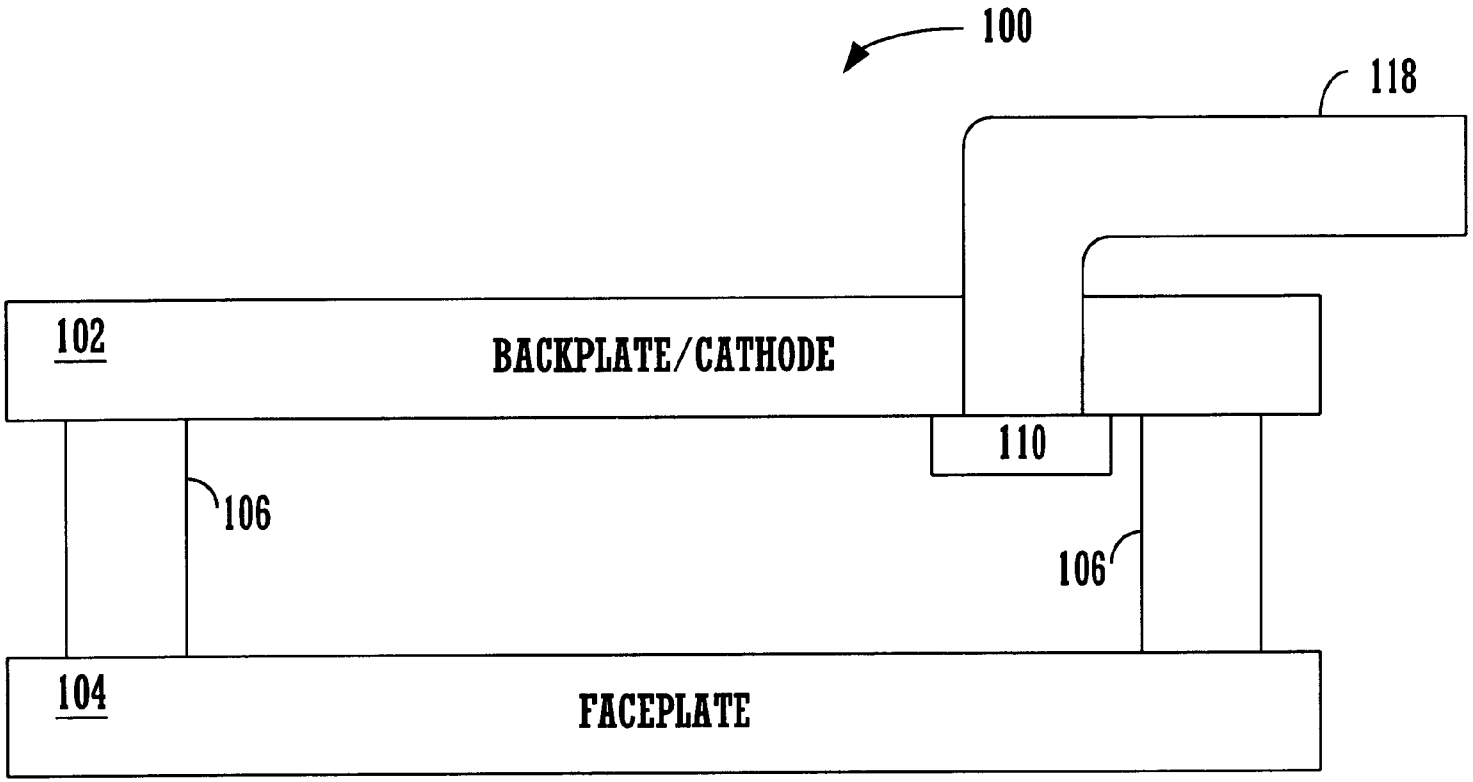
FIGURE 3 (Prior Art)
FIG. 3 is a side sectional view of a display device having tubulation which protrudes beyond the edge of the display device.
Figure 7:
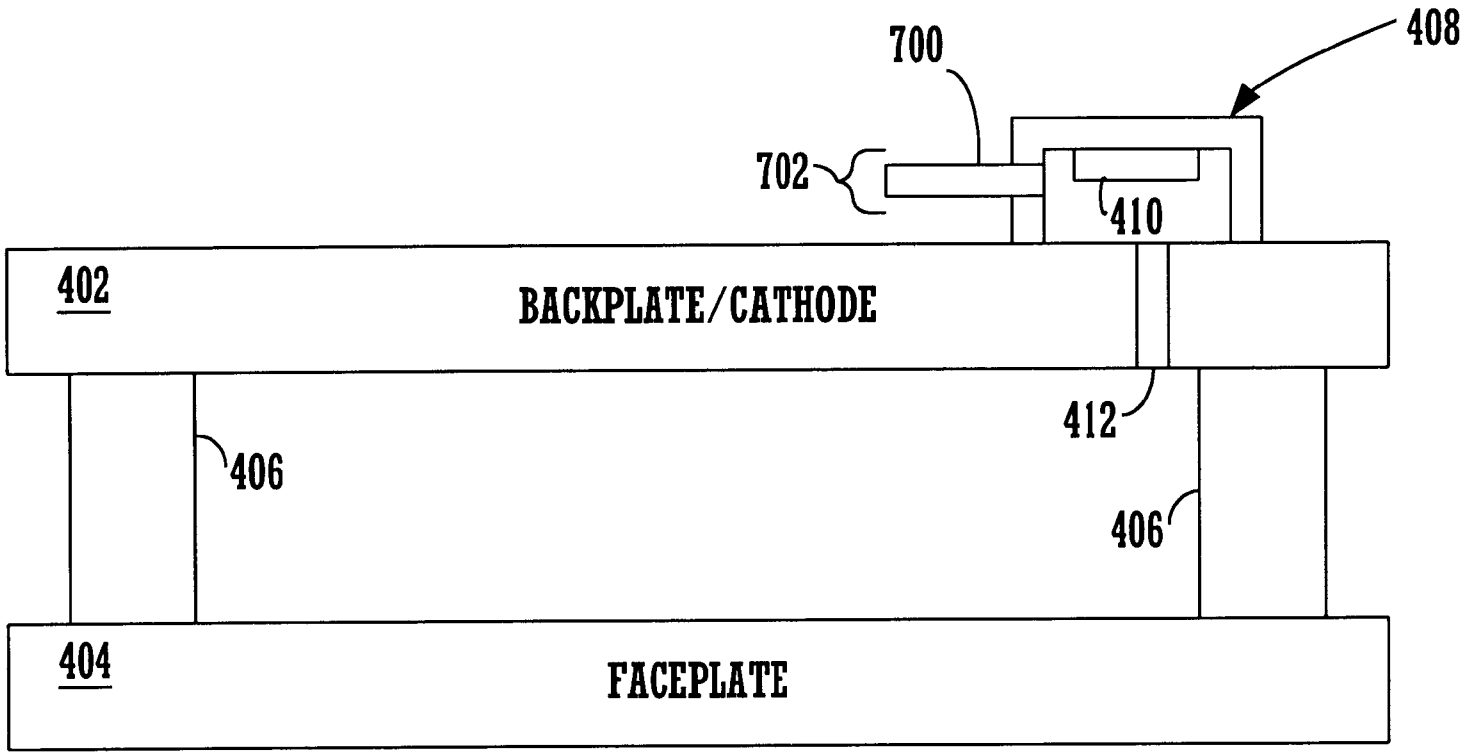
FIG. 7 is a side sectional view of a display device having an auxiliary chamber coupled thereto wherein the auxiliary chamber has tubulation projecting therefrom in accordance with one embodiment of the present claimed invention.

Referring now to FIG. 7, another embodiment of the present invention is shown. In this embodiment, auxiliary chamber 408 of FIG. 4 includes tubulation 700. Unlike conventional devices which attach tubulation directly to the active environment of the display device, tubulation 700 of the present embodiment is attached to auxiliary chamber 40. Tubulation 700 is used during a pump-out process to evacuate the active environment of display device 400 and auxiliary chamber 408. More specifically, the end 702 of tubulation 700 is coupled to a vacuum source, not shown. The vacuum source evacuates the interior of auxiliary chamber 408 and the active environment of display device 400 via tubulation 700. In the present embodiment, tubulation 700 extends from auxiliary chamber 408 such that it does not extend beyond the edge of the display device 400. More particularly, in the embodiment of FIG. 7, tubulation 700 projects "inwardly" (i.e. towards the central portion of display device 400) as opposed to projecting outwardly (i.e. directly towards a border of display device 400). Thus, unlike conventional tubulation configurations (see e.g. tubulation 118 of Prior Art FIG. 3), tubulation 700 of the present embodiment does not interfere with, for example, sealing processes used to secure cathode 402 and faceplate 404 together. Additionally, unlike conventional tubulation configurations (see e.g. tubulation 114 of Prior Art FIG. 2), tubulation 700 maintains a low profile and, thus, does not significantly alter or increase the "envelope" of display device 400. Hence, low profile, inwardly projecting tubulation 700 does not restrict or limit the locations and environments in which display device 400 can be used. The present invention is also suited to embodiments in which tubulation 700 projects other than towards the central portion of display device 400.

Referring still to FIG. 7, in the present embodiment, tubulation 700 is comprised of metal. More particularly, in the embodiment of FIG. 7, tubulation 700 is comprised of a soft metal such as, for example, nickel, copper, aluminum, and the like. Although such soft metals are recited in the present embodiment, the present invention is also well suited to the use of various other types of metals. Likewise, the present embodiment is also well. suited to forming tubulation 700 of glass, ceramic, or various other non-metal materials.

With reference still to FIG. 7, several substantial advantages are achieved by forming tubulation 700 of metal. For example, metal tubulation 700 is generally stronger than glass tubulation. This increased strength improves the robustness of the manufacturing process and leads to improved yield. Also, metal tubulation is more easily manufactured and coupled to auxiliary chamber 408. For example, when auxiliary chamber 408 is formed of metal, if tubulation 700 is also formed of metal, a welding process can reliably secure tubulation 700 to auxiliary chamber 408. The present invention is also well suited to securing metal tubulation to a metal or non-metal auxiliary chamber using various other bonding procedures. For example, in an embodiment in which auxiliary chamber 408 is comprised of ceramic material and tubulation 700 is comprised of metal, tubulation 700 is well suited to being, for example, frit-sealed or brazed to ceramic auxiliary chamber 408.

Figure 8:
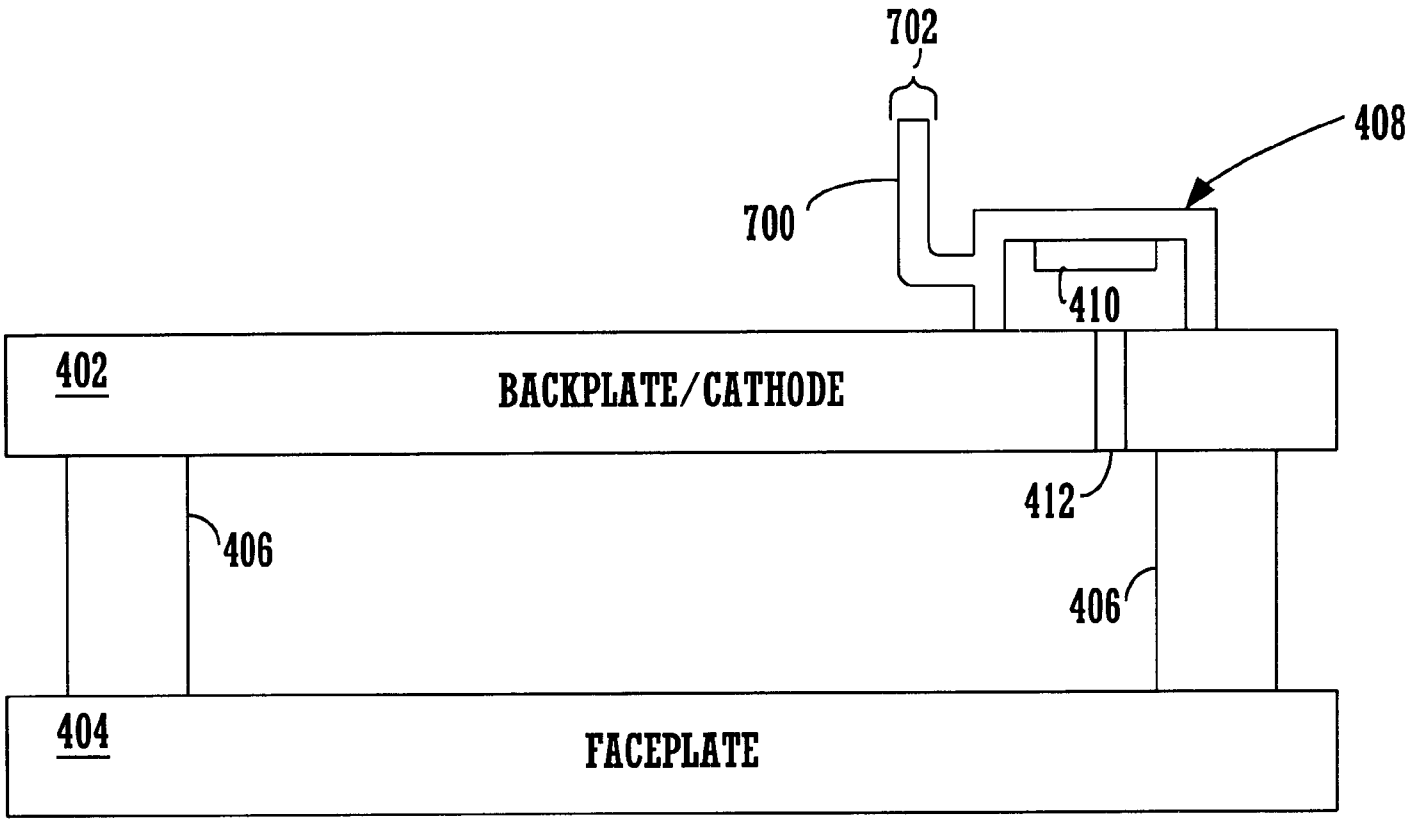
FIG. 8 is a side sectional view of a display device having an auxiliary chamber coupled thereto wherein the auxiliary chamber has bent tubulation projecting therefrom in accordance with one embodiment of the present claimed invention.

Referring now to FIG. 8, another advantage associated with forming tubulation 700 from metal is shown. In the embodiment of FIG. 8, tubulation 700 is comprised of a bendable metal. As a result, tubulation 700 is bent to facilitate coupling of end 702 of tubulation 700 to a vacuum source. Thus, despite the location and orientation of auxiliary chamber 408 tubulation 700 can be bent or configured to provide ready access for a vacuum source or other device to end 702 of tubulation 700. Furthermore, after the evacuation process, tubulation 700 can be bent to the position shown in FIG. 7. In so doing, the present embodiment maintains its low profile and, thus, does not significantly alter or increase the "envelope" of display device 400. Additionally, tubulation 700 of the present embodiment can be configured to extend beyond the edge of display device 400 to facilitate easy access to a vacuum source. However, prior to the evacuation process, tubulation 700 can be bent to ensure that tubulation 700 does not interfere with, for example, a laser sealing process. In an embodiment in which tubulation 700 is formed of glass, the glass tubulation is heated and is then bent to a desired shape.

Figure 9:
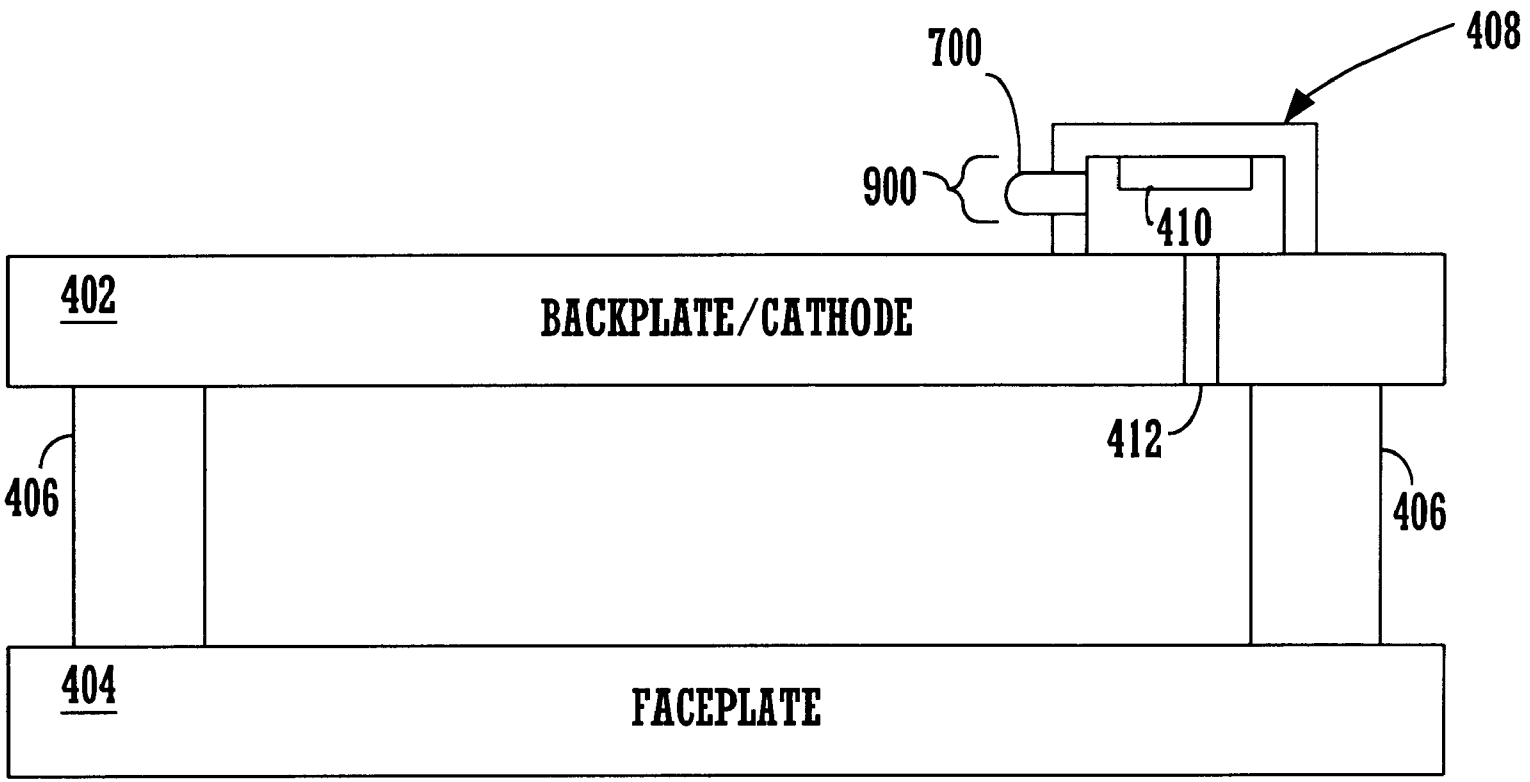
FIG. 9 is a side sectional view of a display device having an auxiliary chamber coupled thereto wherein the auxiliary chamber has sealed tubulation projecting therefrom in accordance with one embodiment of the present claimed invention.

With reference next to FIG. 9, another embodiment of the present invention is shown in which tubulation 700 extending from auxiliary chamber 408 has a sealed end 900. Typically, after a final evacuation process, the present embodiment seals tubulation 700 forming sealed end 900. In so doing, an evacuated environment is maintained within auxiliary chamber 408 and the active environment of display device 400. In the embodiments of the present invention, sealed end 900 is achieved in any of numerous ways. In an embodiment in which tubulation 700 is comprised of glass, a heating process is used to obtain sealed end 900. When tubulation 700 is comprised of metal, the present embodiment forms sealed end 900 using a non-thermal sealing process. Such a non-thermal process includes, for example, a mechanical pinching process, and the like. By using such a non-thermal sealing process, the present embodiment does not subject components of display device 400 and/or auxiliary chamber 408 to a deleterious thermal load or thermal shock. Additionally, such a mechanical sealing process results in minimal residual tubulation extending from auxiliary chamber 408.

Figure 10:
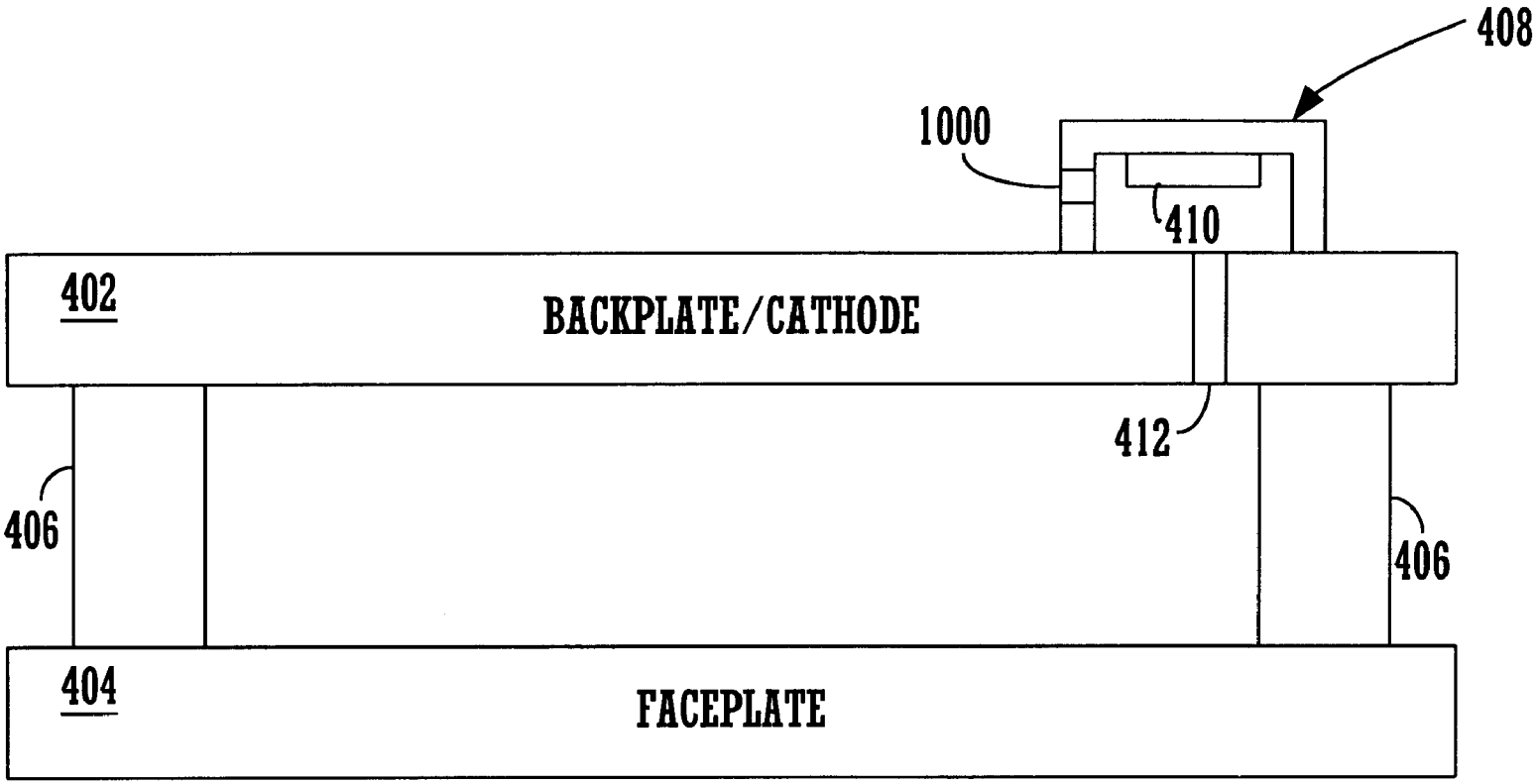
FIG. 10 is a side sectional view of a display device having an auxiliary chamber coupled thereto wherein the auxiliary chamber is plug sealed in accordance with one embodiment of the present claimed invention.

With reference now to FIG. 10, auxiliary chamber 408 of the present embodiment does not have tubulation extending therefrom. Instead, auxiliary chamber 408 is sealed using a plug seal 1000. In such an embodiment, a plug of, for example, molten quartz glass or indium is used to seal auxiliary chamber 408 after an evacuation process. As can be seen from the embodiment of FIG. 10, by using plug seal 1000, the present embodiment maintains a low profile and, thus, does not significantly alter or increase the "envelope" of display device 400. Additionally, a plug seal can be used at any location on auxiliary chamber 408. Hence, low profile, plug seal 1000 does not restrict or limit the locations and environments in which display device 400 can be used.

Figure 11:
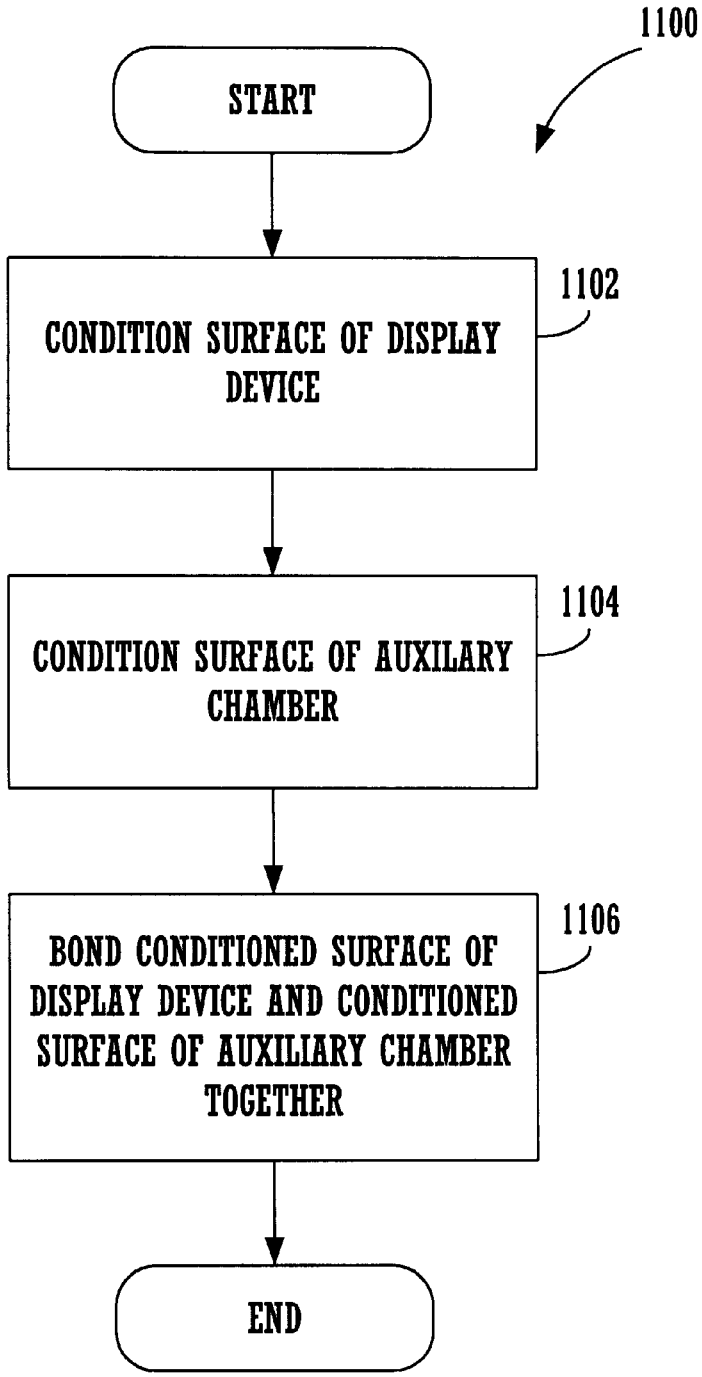
FIG. 11 is a flow chart of steps performed to attach an auxiliary chamber to surface of a display device in accordance with one embodiment of the present claimed invention.

With reference now to FIG. 11, a flow chart 1100 of steps used to attach auxiliary chamber 408 to cathode 402, both of FIGS. 4,5, and 7–10, is shown. Certain types of sealing material such as, for example, low temperature sealing frit do not bond well to smooth surfaces. That is, in certain conditions, when using such a sealing frit, the seal or bond created between two surfaces may be more mechanical then chemical. The present embodiment provides a method for attaching one smooth surface (e.g. cathode 402 or other surface of display device 400) and another smooth surface (e.g. the bottom surface of auxiliary chamber 408) together. As shown at step 1102, the present embodiment first conditions a surface of display device 400 such that a conditioned surface of display device 400 is generated. In the present embodiment, the surface of display device 400 is the top surface of cathode 402 of display device 400. In so doing, the conditioned surface of display device 400 is then adapted to have auxiliary chamber 408 bonded thereto. An embodiment of the process of step 1102 will be described in detail below in conjunction with the discussion of FIG. 12.

At step 1104, the present embodiment conditions a surface of auxiliary chamber 408 such that a conditioned surface of auxiliary chamber 408 is generated. In the present embodiment, the conditioned surface of auxiliary chamber 408 is the bottom surface of auxiliary chamber 408. In so doing, the conditioned surface of auxiliary chamber 408 is then adapted to be bonded to the conditioned surface of display device 400. An embodiment of the process of step 1104 will be described in detail below in conjunction with the discussion of FIG. 13.

Next, at step 1106, the present embodiment bonds the conditioned surface of auxiliary chamber 408 to the conditioned surface of display device 400. This, bonding step can occur, for example, in a vacuum such that no tubulation need be attached to auxiliary chamber 408. However, the present embodiment is also well suited to bonding auxiliary chamber 408 to cathode 402 in a non-vacuum environment and then evacuating auxiliary chamber 408 and the active environment of display device 400 using tubulation coupled to auxiliary chamber 408. An embodiment of the process of step 1106 will be described in detail below in conjunction with the discussion of FIG. 14. Additionally, the present invention is also well suited to an embodiment in which only the surface of display device 400 is conditioned, or only the surface of auxiliary chamber 408 is conditioned.

Figure 12:
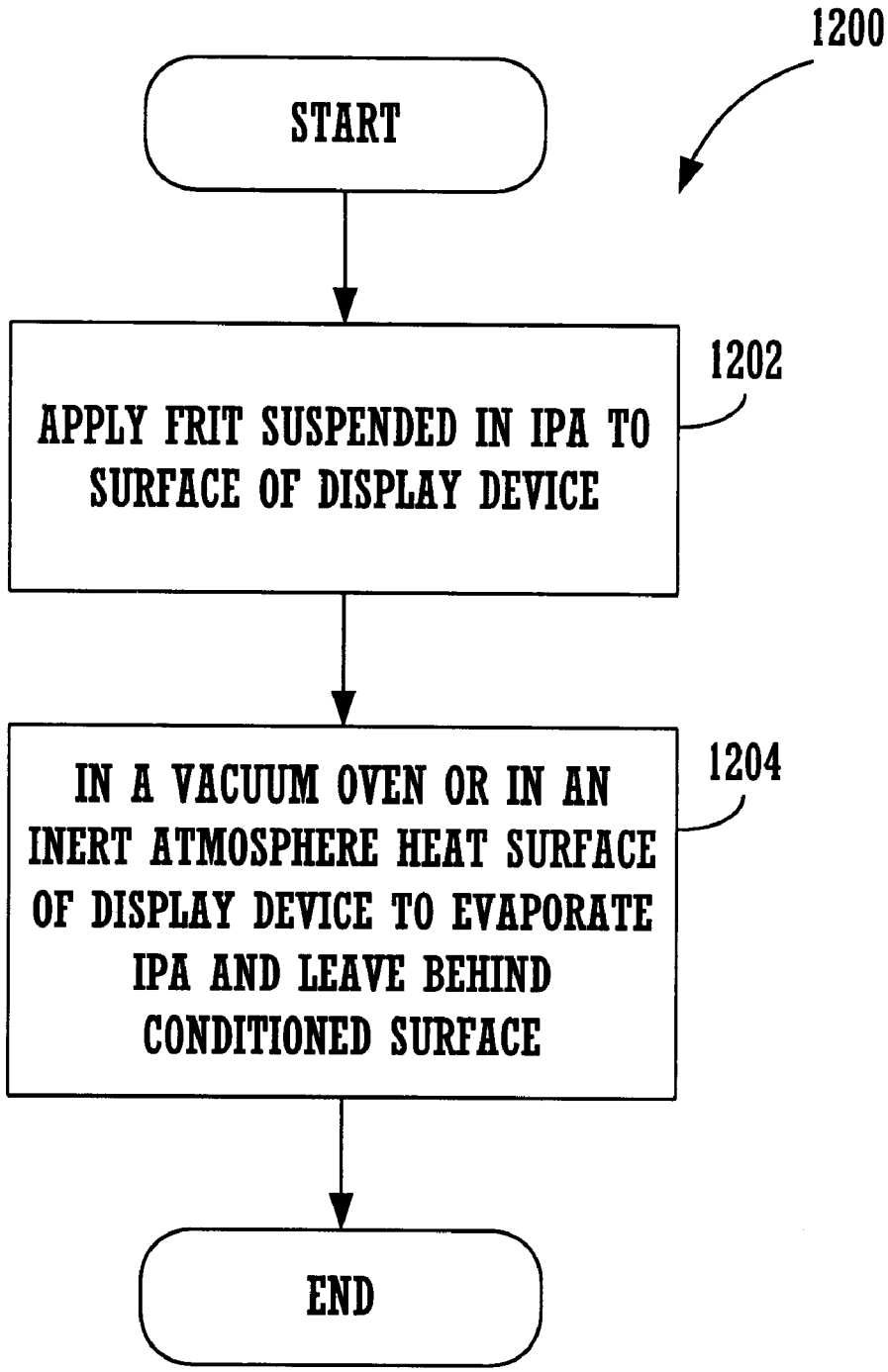
FIG. 12 is a flow chart of steps performed to condition the surface of a display device in accordance with one embodiment of the present claimed invention.

With reference now to FIG. 12, a flow chart 1200 of steps performed during conditioning of a surface of display device 400 is shown. As recited at step 1202, the present embodiment applies frit to the surface of display device 400. More particularly, at step 1202, the present embodiment applies frit without binders to the surface of display device 400. As a result, the frit can be preglazed in vacuum, not in air, so that the active elements of display device will not oxidize and are not deleteriously exposed to any binders. In one embodiment, the frit is suspended in isopropyl alcohol (IPA). The IPA containing frit therein is then, for example, "painted" onto the surface of display device 400 at the desired location.

Next, at step 1204, the surface of display device 400 is subjected to a heating step to expedite evaporation of the IPA. The evaporation of the IPA leaves a frit coating on the surface of display device 400. This heating occurs in a vacuum oven or inert atmosphere at high temperatures. In so doing, the sensitive active elements of display device 400 are not deleteriously exposed to any binders, and the active elements of display device 400 are not deleteriously exposed to an unwanted oxygen atmosphere.

Figure 13:
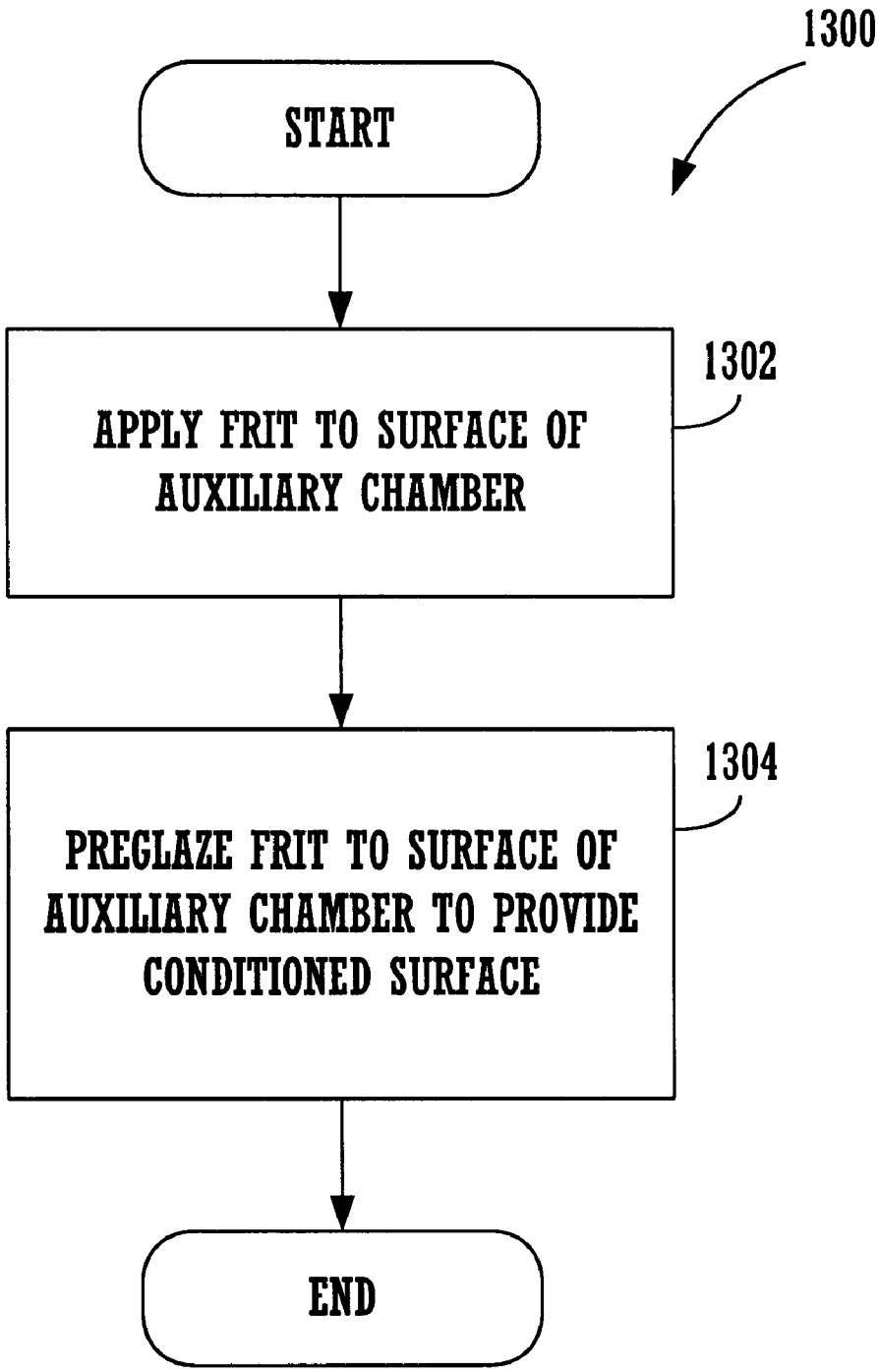
FIG. 13 is a flow chart of steps performed to condition the surface of an auxiliary chamber in accordance with one embodiment of the present claimed invention.

With reference now to FIG. 13, a flow chart 1300 of steps performed during conditioning of a surface of auxiliary chamber 408 is shown. As recited at step 1302, the present embodiment applies frit to the surface of auxiliary chamber 408. More particularly, in the present embodiment, the frit material is applied to the bottom surface of auxiliary chamber 408 where auxiliary chamber 408 will contact display device 400.

Next, at step 1304, the present embodiment preglazes the frit to the bottom surface of auxiliary chamber 408 by heating auxiliary chamber 408 such that the frit is coupled to the bottom surface thereof.

Figure 14:
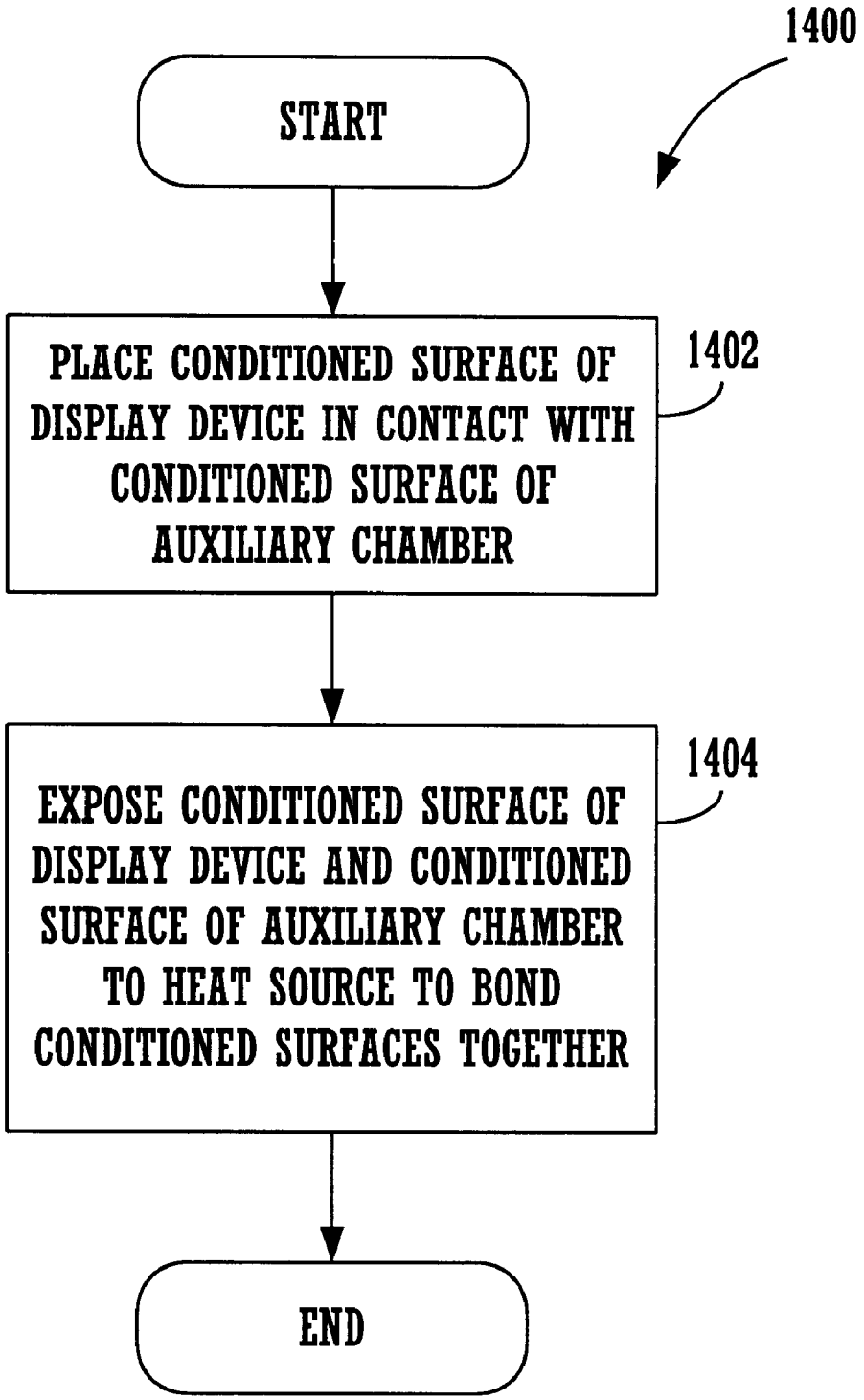
FIG. 14 is a flow chart of steps performed to bond a conditioned surface of an auxiliary chamber to a conditioned surface of a display device in accordance with one embodiment of the present claimed invention.

With reference now to FIG. 14, a flow chart 1400 of steps performed during bonding of the conditioned surface of display device 400 and the conditioned surface of auxiliary chamber 408 is shown. As recited at step 1402, the present embodiment places the conditioned surface of display device 400 and the conditioned surface of auxiliary chamber 408 in contact with each other.

Next, at step 1404, the present embodiment exposes the conditioned surface of display device 400 and the conditioned surface of auxiliary chamber 408 to a heat source such that the conditioned surface of display device 400 and the conditioned surface of auxiliary chamber 408 are bonded together. In the present embodiment, the conditioned surface of display device 400 and the conditioned surface of auxiliary chamber 408 are exposed to a laser heating source. Although such heating is recited in the present embodiment, the present invention is also well suited to exposing the conditioned surface of display device 400 and the conditioned surface of auxiliary chamber 408 to various other heating methods such as, for example, radio frequency (RF) heating, oven heating, and the like. Additionally, in one embodiment, the conditioned surface of display device 400 and the conditioned surface of auxiliary chamber 408 are exposed to the heat source in an inert environment such that the heat does not damage active elements of display device 400. In an embodiment in which a laser is used to bond display device 400 and auxiliary chamber 408 together, such bonding can be accomplished without requiring the use of a low temperature frit suspended in IPA.

Figure 15:
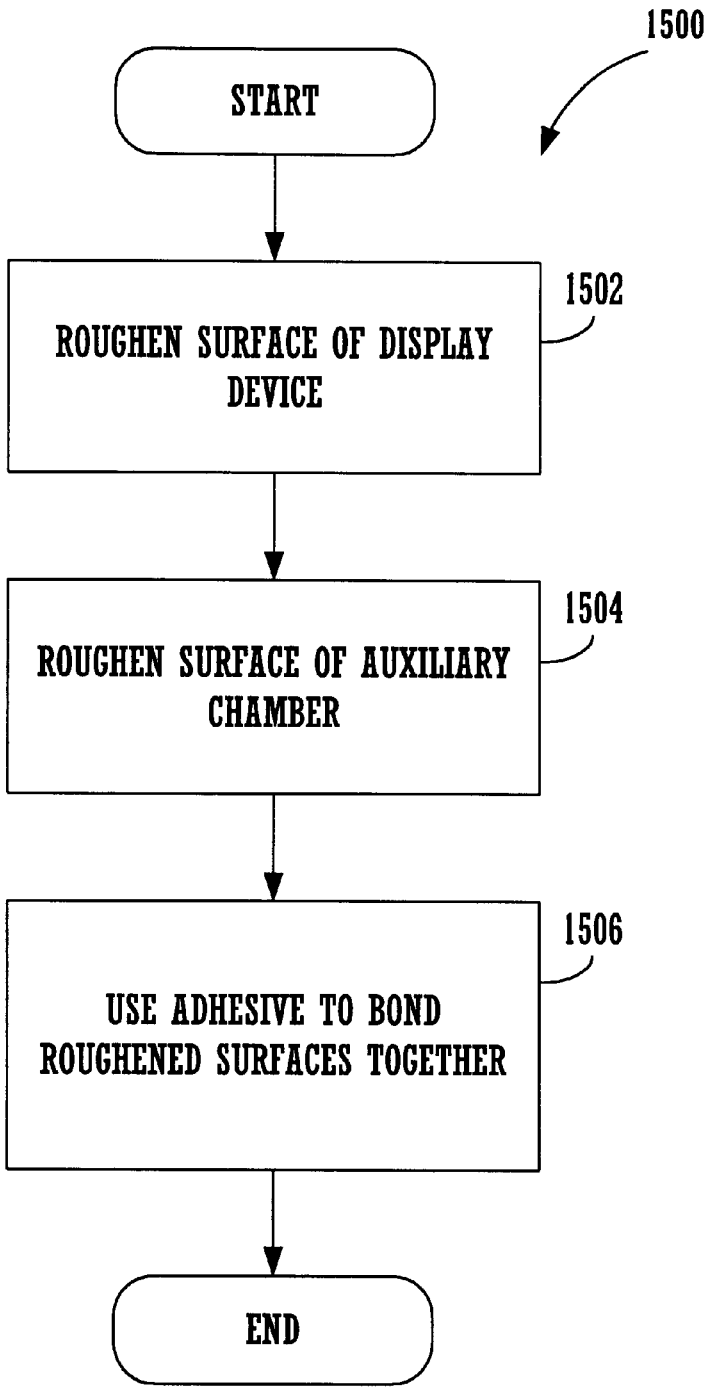
FIG. 15 is a flow chart of steps performed to attach an auxiliary chamber to surface of a display device using an adhesive in accordance with one embodiment of the present claimed invention.

With reference now to FIG. 15, a flow chart 1500 of steps performed during another embodiment of the present invention is shown. In this embodiment of the present invention, the surface of display device 400 and the surface of auxiliary chamber 408 are conditioned by a roughening process. As recited in step 1502, the surface of display device 400 is roughened using for example, a chemical process, a mechanical process, a laser process, and the like. This process is used to create topography on the surface of display device 400 wherein the topography facilitates a bonding process. In the present embodiment, the chemical roughening process includes, for example, exposing the surface of display device 400 to an acid etch process. The mechanical roughening process includes, for example, sandblasting or sanding the surface of display device 400. The laser roughening process includes, for example, exposing the surface of display device 400 to a laser to mark or pit the surface thereof.

At step 1504, the surface of auxiliary chamber 408 is roughened using for example, a chemical process, a mechanical process, a laser process, and the like. This process is used to create topography on the surface of auxiliary chamber 408 wherein the topography facilitates a. bonding process. In the present embodiment, the chemical roughening process includes, for example, exposing the surface of auxiliary chamber 408 to an acid etch process. The mechanical roughening process includes, for example, sandblasting or sanding the surface of auxiliary chamber 408. The laser roughening process includes, for example, exposing the surface of auxiliary chamber 408 to a laser to mark or pit the surface thereof.

At step 1506, the present embodiment uses an adhesive to bond the roughened surface of display device 400 and the roughened surface of auxiliary chamber 408 together. The present embodiment is well suited to using any of various types of adhesive to accomplish step 1506. Additionally, the present invention is also well suited to an embodiment in which only the surface of display device 400 is roughened, or only the surface of auxiliary chamber 408 is roughened. Furthermore, the present invention is also well suited to an embodiment in which the surface of display device 400 is conditioned with frit, and the surface of auxiliary chamber 408 is roughened as described above, or surface of display device 400 is roughened as described above, and the surface of auxiliary chamber 408 is conditioned with frit.

Figure 16A:
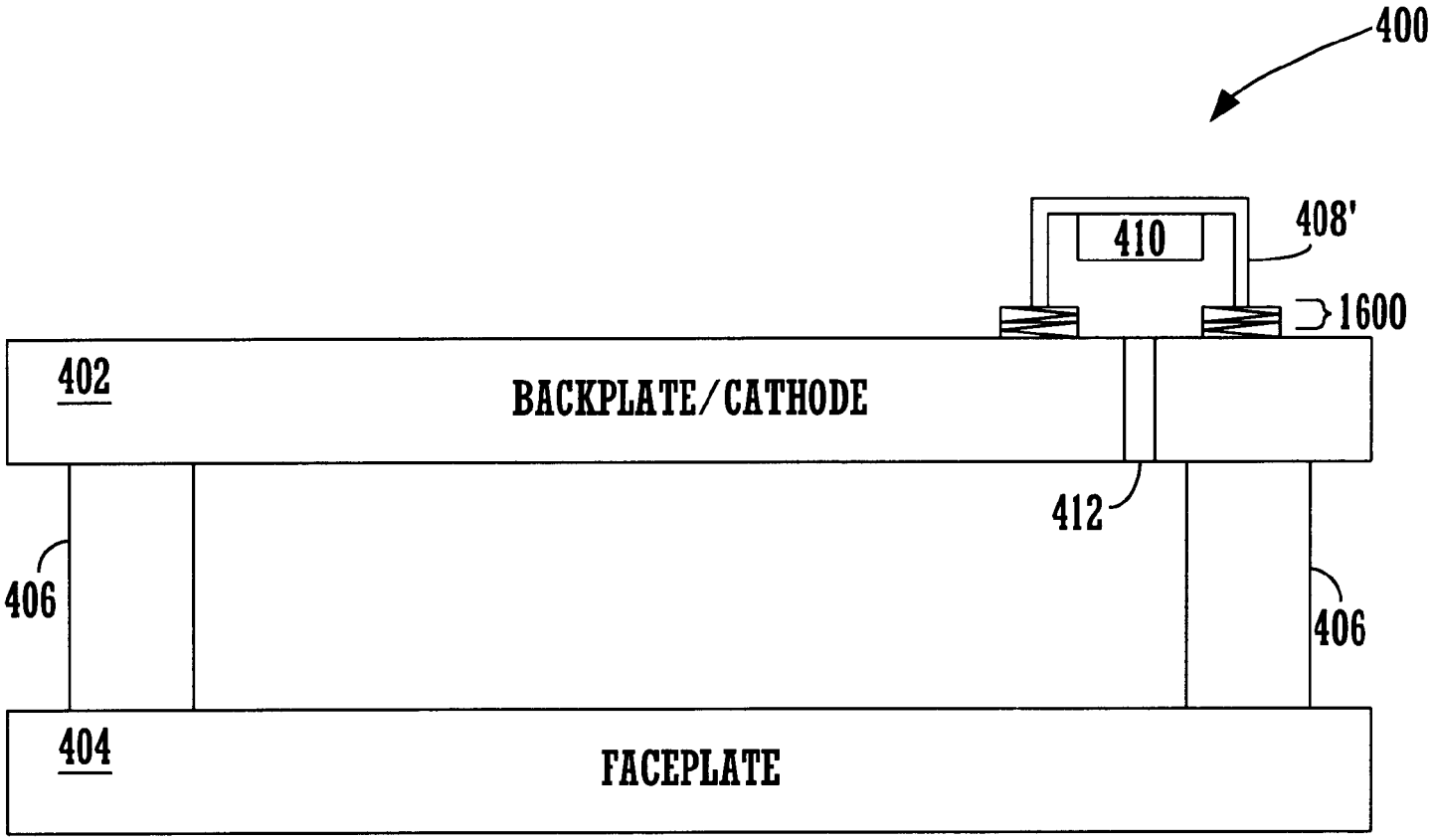
FIG. 16A is a side sectional view of a display device having an auxiliary chamber in a compressed state coupled thereto wherein the auxiliary chamber has a variable volume in accordance with one embodiment of the present claimed invention.

With reference now to FIG. 16A, another embodiment of the present invention is shown in which an auxiliary chamber 408' has a variable volume. More specifically, in the present embodiment auxiliary chamber 408' has an expandable portion 1600. In FIG. 16A, expandable portion 1600 is in a compressed state. In the present embodiment, expandable portion is comprised of a bellow-like structure, which is maintained in the compressed state during evacuation and sealing (i.e. tip-off) of display 400. As a result, the present embodiment maintains a low profile as described above in detail.

Figure 16B:
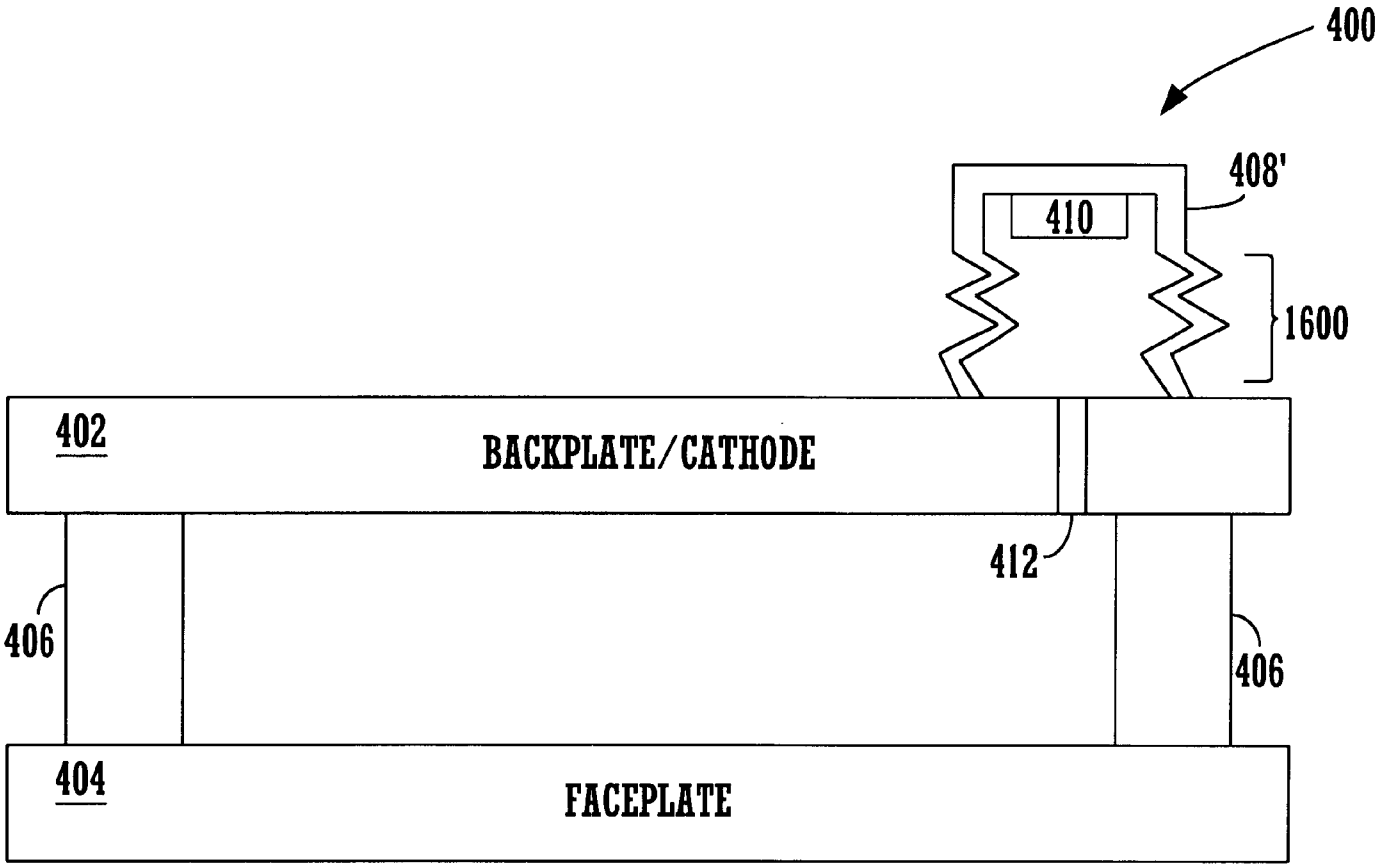
FIG. 16B is a side sectional view of a display device having an auxiliary chamber in an expanded state coupled thereto wherein the auxiliary chamber has a variable volume in accordance with one embodiment of the present claimed invention.

Referring now to FIG. 16B, auxiliary chamber 408' is shown in an expanded state. As a result, the volume of auxiliary chamber has been increased. Thus, the present embodiment provides an auxiliary chamber having a variable volume. In operation, the present embodiment is extended after evacuation and sealing (i.e. tip-off) of display 400 to increase the volume of auxiliary chamber 408'. Getter 410 is then activated (e.g. flashed), and then auxiliary chamber 408' is returned to its compressed state to return display 400 to the desired low profile. In this embodiment, the surface of the getter will be deposited (flashed), giving improved dispersion of the getter material, and, in the end, maintaining the desired low-profile.

Figure 17A:
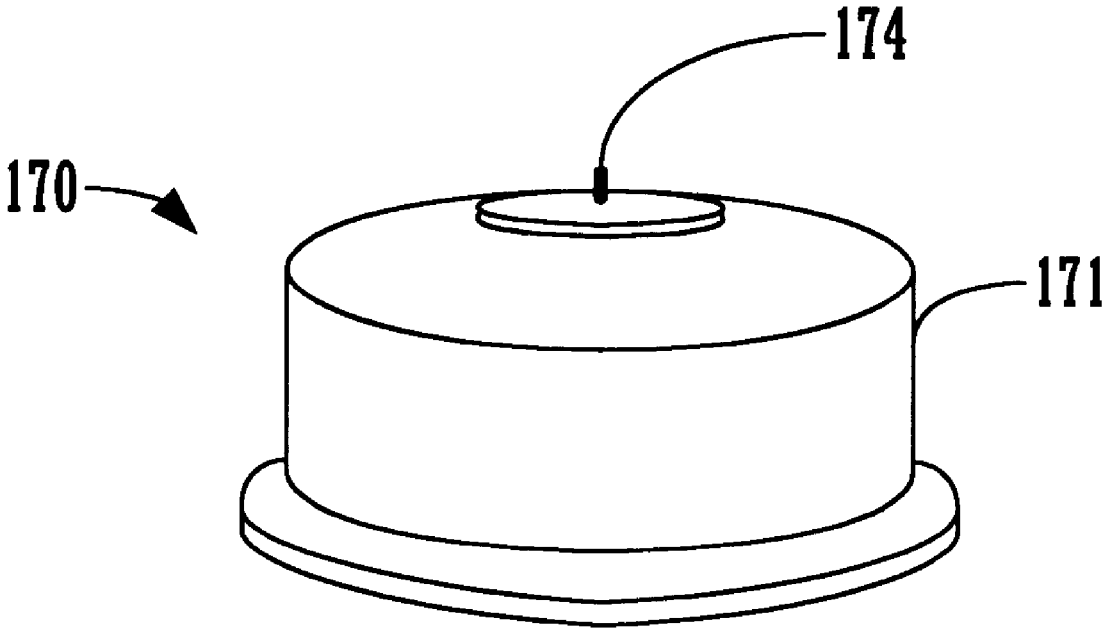
FIG. 17A is a perspective view of an auxiliary chamber that includes a cylindrical housing in accordance with one embodiment of the present claimed invention.
Figure 17B:
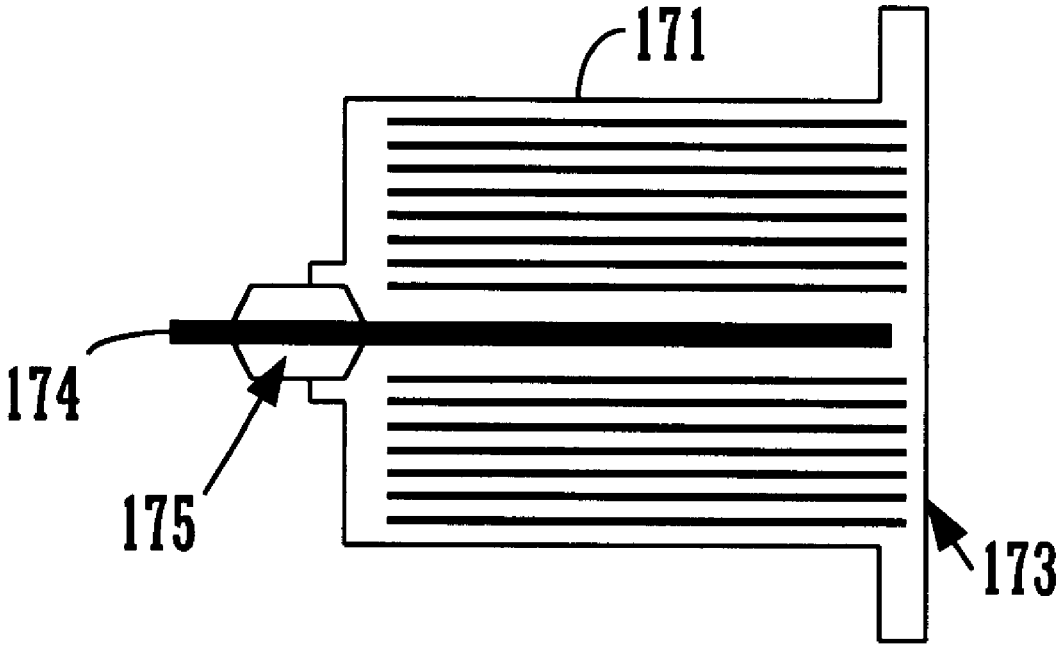
FIG. 17B is a side sectional view of an auxiliary chamber that includes a cylindrical housing in accordance with one embodiment of the present claimed invention.
Figure 17C:
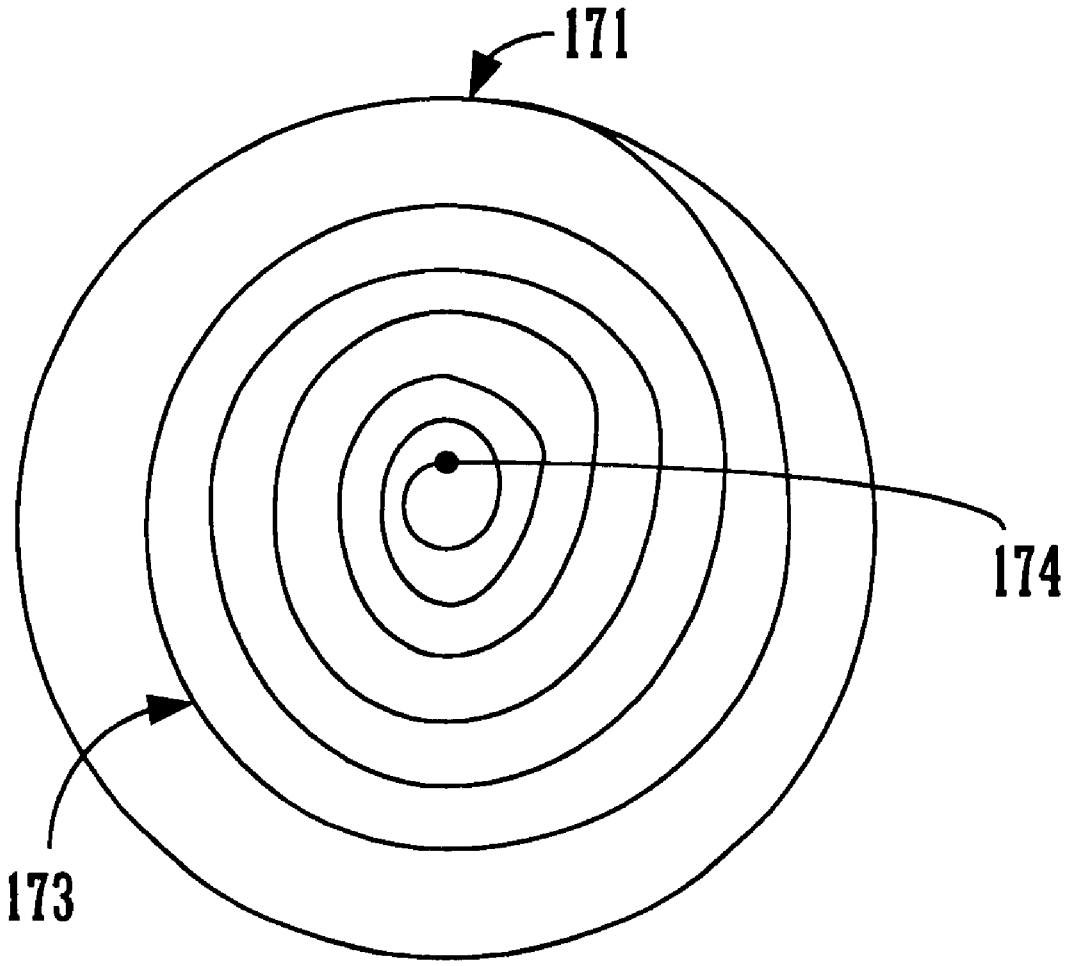
FIG. 17C is a bottom view of an auxiliary chamber that includes a spiral of NEG material in accordance with one embodiment of the present claimed invention.

With reference to FIGS. 17A–17C, an embodiment of the present invention is shown in which auxiliary chamber 170 includes cylindrical housing 171. In one embodiment, cylindrical housing 171 is formed of steel. However, the present invention is well suited to the use of various other types of metals. The present invention is also well suited to the use of a low expansion alloy that is close to the coefficient of thermal expansion of the display glass.

In the embodiment shown in FIGS. 17B–17C, a getter is formed of a spiral of Non-Evaporable Getter (NEG) material 173. Conductive element 174 is disposed centrally within each cylindrical housing 171 and extends through insulator 175 that forms a hermetic seal between cylindrical housing 171 and conductive element 174. Conductive element 174 connects electrically to one end of NEG material 173. The other end of NEG material 173 is electrically connected to cylindrical housing 171. Passing a current through conductive element 174, and through NEG material 173, and out through cylindrical housing 171, heats NEG material 173 for activation of NEG material 173.

Figure 17D:
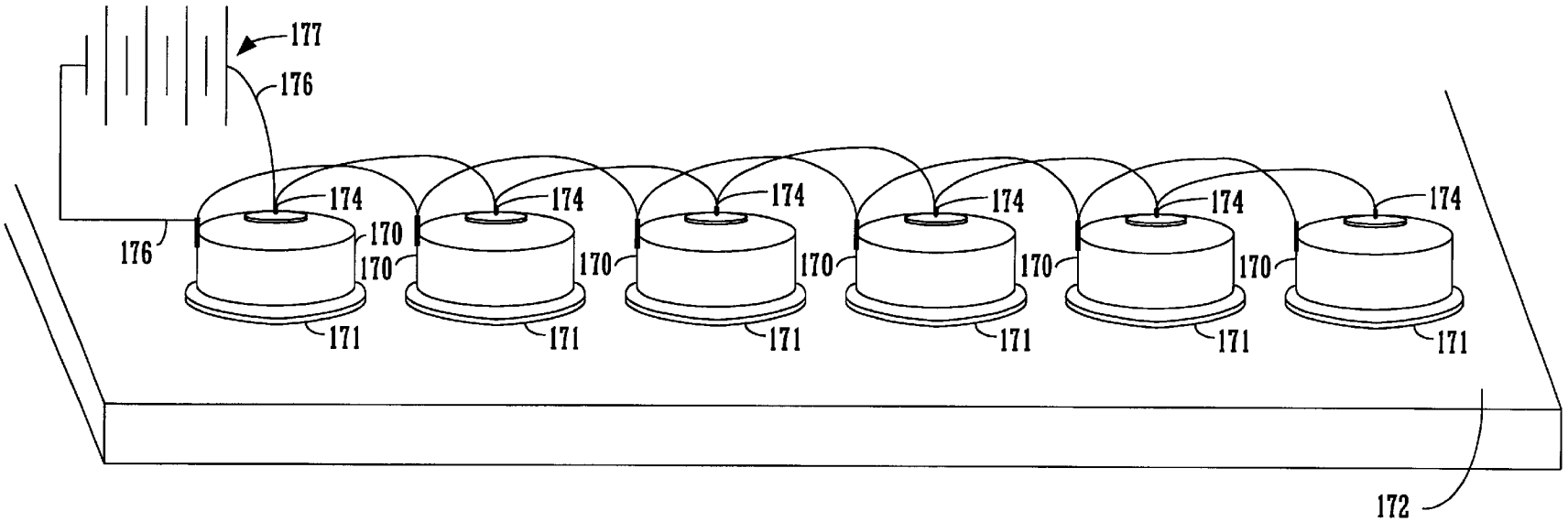
FIG. 17D is a perspective view of auxiliary chambers attached to a surface of a display in accordance with one embodiment of the present claimed invention.

In the embodiment shown in FIG. 17D a row of auxiliary chambers 170 are attached to display glass 172. Openings (not shown) extend through display glass 172 below each of auxiliary chambers 170. In one embodiment, each of auxiliary chambers 170 are attached to display glass 172 using a metal solder, solder glass or other adhesive by heating or friction welding. However, the present invention is well suited to the use of other methods for attaching auxiliary chambers 170 to display glass 172.

Referring to FIG. 17D, in one embodiment, power source 177 is electrically coupled to cylindrical housings 171 and to conductive elements 174 by conductive wire 176. Upon the application of power, NEG material 173 within each cylindrical housing 171 is activated. Though the embodiment shown in FIG. 17D is wired in series, the present invention is well suited to an embodiment in which each of cylindrical housings 171 and conductive elements 174 are wired in parallel to power source 177. In an embodiment in which each of cylindrical housings 171 are wired in parallel to power source 177, cylindrical housings 171 can be individually activated.

Referring still to FIG. 17D, in one embodiment, each cylindrical housing 171 has a reduced height. In one specific embodiment, each cylindrical housing has a height of approximately 0.5 centimeters and a diameter of approximately 1 centimeter. In this embodiment, more than 500 square millimeters of 0.4 millimeter thick NEG material is disposed within cylindrical housing 171. Because cylindrical housing 171 is made of metal and has a small size relative to prior art devices, the present invention is less likely to adversely affect mechanical properties (e.g. compliance, seal strength, etc.) than prior art large glass auxiliary compartments.

The embodiments shown in FIGS. 17A–17D allow for periodic activation by current heating during various stages of conditioning. In addition, the embodiments shown in FIGS. 17A–17D can be reactivated throughout the life of the display. Thus, for example, NEG material 173 can be reactivated at intervals during the consumer life of the display. For example, NEG material 173 can be reactivated during battery charging operations, during initial power-up of the display, etc. This would extend the lifetime of the display by periodically improving vacuum and compensating for the long-term vacuum degradation associated with outgassing and seal permeability.

Figure 17E:
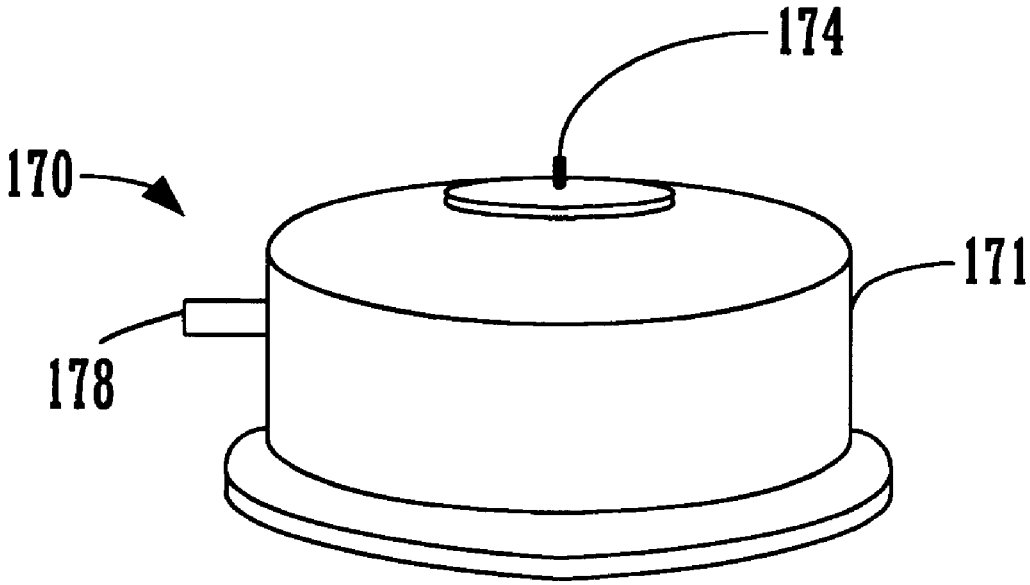
FIG. 17E is a perspective view of an auxiliary chamber that includes a cylindrical housing and tubulation in accordance with one embodiment of the present claimed invention.

In one alternate embodiment that is shown in FIG. 17E, tubulation 178 extends from cylindrical housing 171. In one embodiment, tubulation 178 is a crimpable pump port for evacuation of auxiliary chamber 170 and the display device to which auxiliary chamber 170 is attached.

Figure 17F:
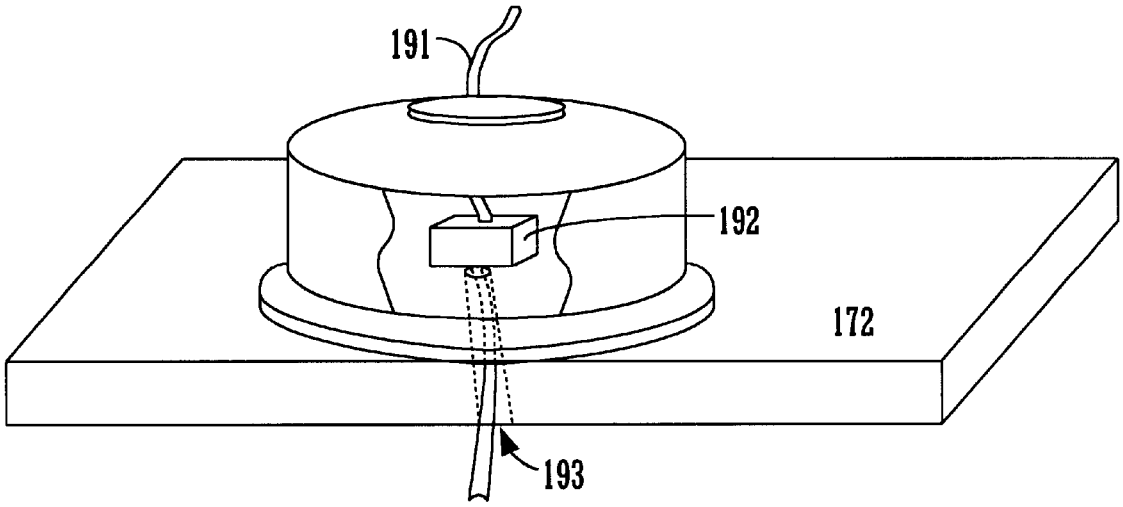
FIG. 17F is a side cut away view of an auxiliary chamber that includes a cylindrical housing and a high voltage anode feed-through in accordance with one embodiment of the present claimed invention.

In yet another embodiment that is shown in FIG. 17F, high voltage (anode) feed-through is provided by conductive cable 191 that extends through opening 193 in display glass 172. In one embodiment, spring-loaded contact 192 is attached to conductive cable 191.

Figure 18:
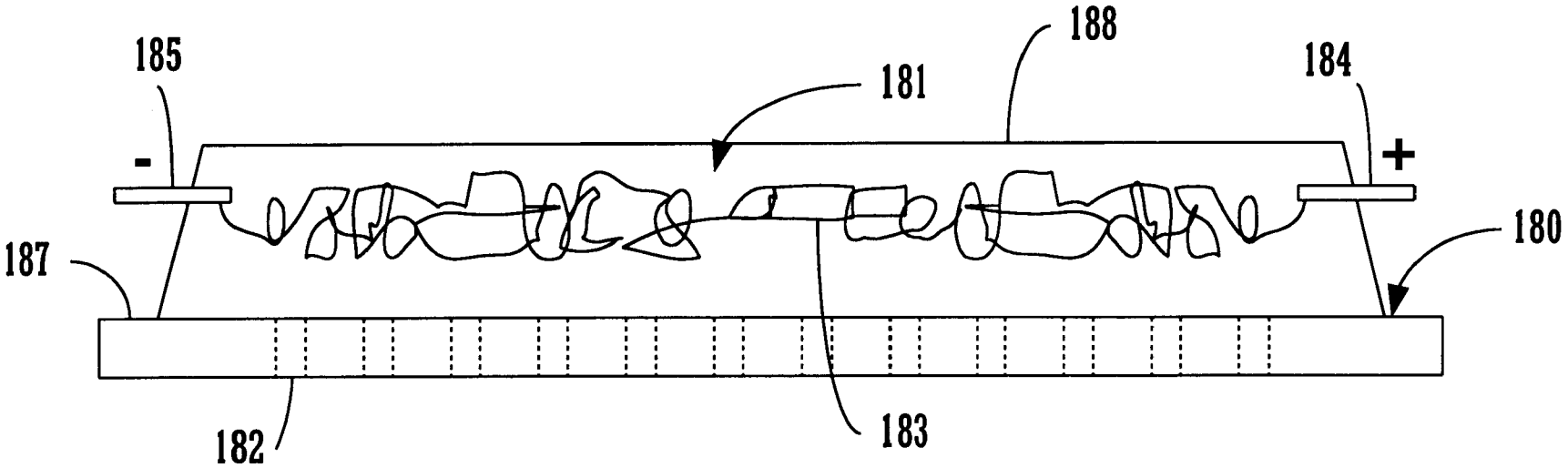
FIG. 18 is a side sectional view of an auxiliary chamber within which a flash bulb is disposed in accordance with one embodiment of the present claimed invention.

Referring now to FIG. 18, an embodiment is shown that includes barium flash bulb 181 that is disposed within auxiliary chamber 180. In the present embodiment, barium flash bulb 181 includes barium material that is disposed on filament 183. In one embodiment, filament 183 is a bundled filament such as bundled filament 600 of FIG. 6A. Alternatively, filament 183 is arranged in a lattice configuration to produce a "latticed filament" such as lattice filament 602 of FIG. 6B. In the present embodiment, filament 183 is comprised of tungsten. However, the present embodiment is also well suited to the use of various other filament materials, such as, for example, titanium, tantalum, tungsten, a tantalum-titanium alloy, and the like.

Still referring to FIG. 18, in one embodiment, auxiliary chamber 180 includes a sieve-like bottom plate 187 that includes openings 182 extending therethrough. Openings 182 allow contaminant particles to move into auxiliary chamber 180. In one embodiment, bottom plate 187 is coated with frit prior to assembly to housing 188. Once auxiliary chamber 180 is assembled, filament 183 is retained within auxiliary chamber 180. This provides for easy installation of auxiliary chamber 180 to a display device because filament 183 is retained within auxiliary chamber 180 during transport and during the attachment of auxiliary chamber 180 to the display glass.

Continuing with FIG. 18, electrical feed-through 184 and electrical feed-through 185 are electrically coupled to filament 183. In one embodiment, electrical feed-through 184 and electrical feed-through 185 are fritted to auxiliary chamber 180. Alternatively, electrical feed-throughs 184–185 are brazed to auxiliary chamber 180. In one embodiment, auxiliary chamber 180 is ceramic or glass. Alternatively, auxiliary chamber 180 is metal that is coated with an insulating material such as, for example, ceramic.

In one embodiment, activation is accomplished by applying 6–12 volts of direct current to electrical feed-throughs 184–185. When electrical current is applied to electrical feed-throughs 184–185, filament 183 disperses or "flashes" the barium material coated thereon throughout the interior surface of auxiliary chamber 180.

Though a single flash bulb is shown in the embodiment of FIG. 18, the present invention is also well suited to an embodiment in which the filament is partitioned into two or more smaller flash bulbs. The use of two flash bulbs allows for operation of one flash bulb during assembly and allows for operation of the second flash bulb by the customer. Several substantial advantages are realized by the present embodiment, many of which are discussed with reference to the embodiments of FIGS. 4–6D.

Figure 19:
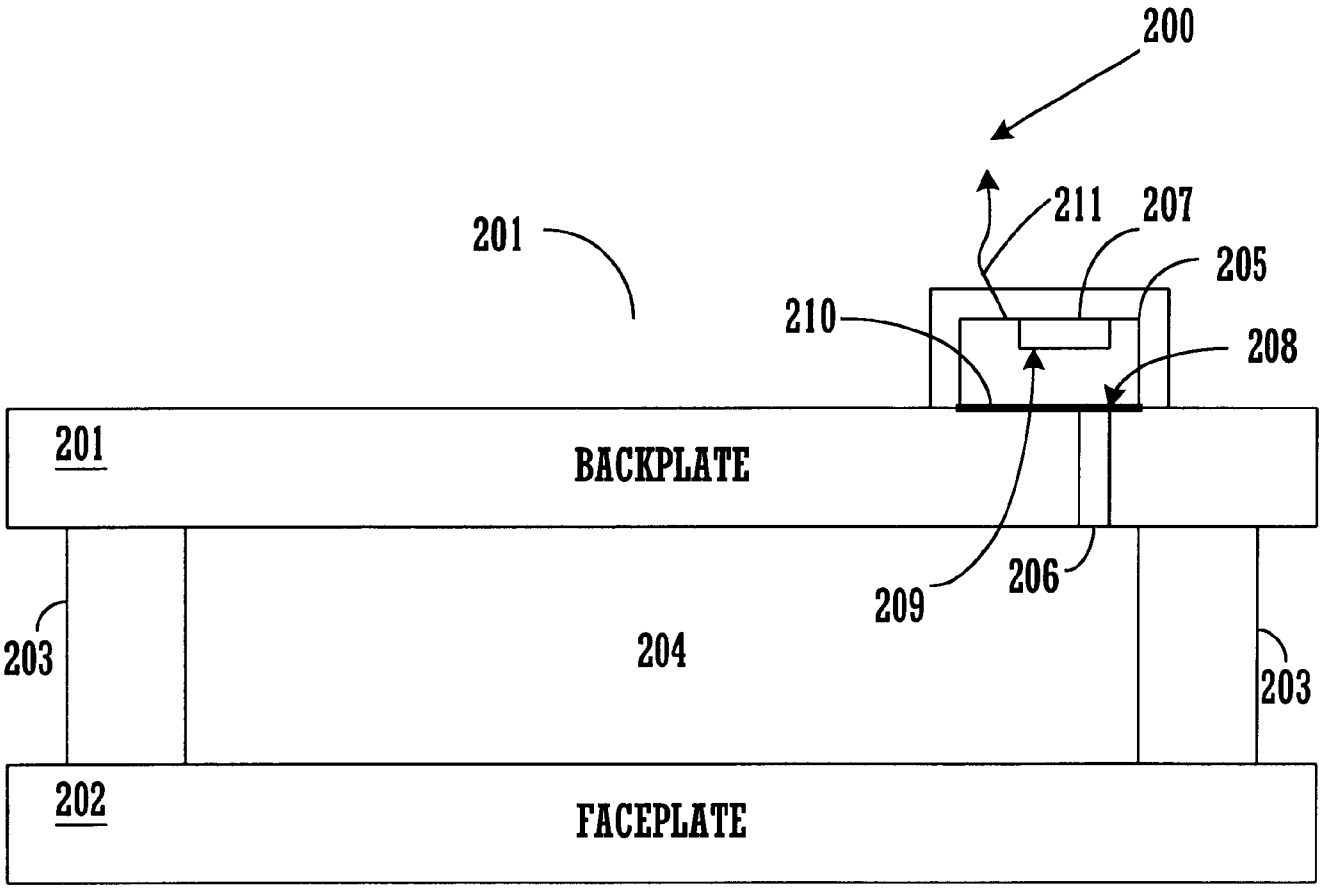
FIG. 19 is a side sectional view of a display device having an auxiliary chamber coupled thereto and having a low emissivity surface and a high emissivity surface in accordance with one embodiment of the present claimed invention.

It has been found that flashing of barium getters produces gasses that can be deleterious to the active areas of the display. In the present embodiment, the barium getter is activated during the evacuation of the display. This evacuates gasses produced by the barium getter, eliminating the deleterious effects of the gasses produced by activation of the barium getter. Referring to FIG. 19, a flat panel display 200 is shown that includes backplate 201, faceplate 202, perimeter seal 203, vacuum gap 204 and auxiliary compartment 205. Openings 206 extend through backplate 201. High emissivity surface 209 allows for heat to be conducted away from low emissivity surface 208. In one specific embodiment, high emissivity surface 209 is a glass surface that is uncoated and low emissivity surface 208 is a glass surface that is coated with metal film 210.

Continuing with FIG. 19, getter 207 is disposed within auxiliary compartment 205 such that, upon activation, getter 207 deposits a film of getter material over low emissivity surface 208. The heat generated by flashing getter 207 is conducted out of the back of auxiliary compartment 205 as shown by arrow 211. This minimizes the temperature increase of low emissivity surface 208.

Figure 20:
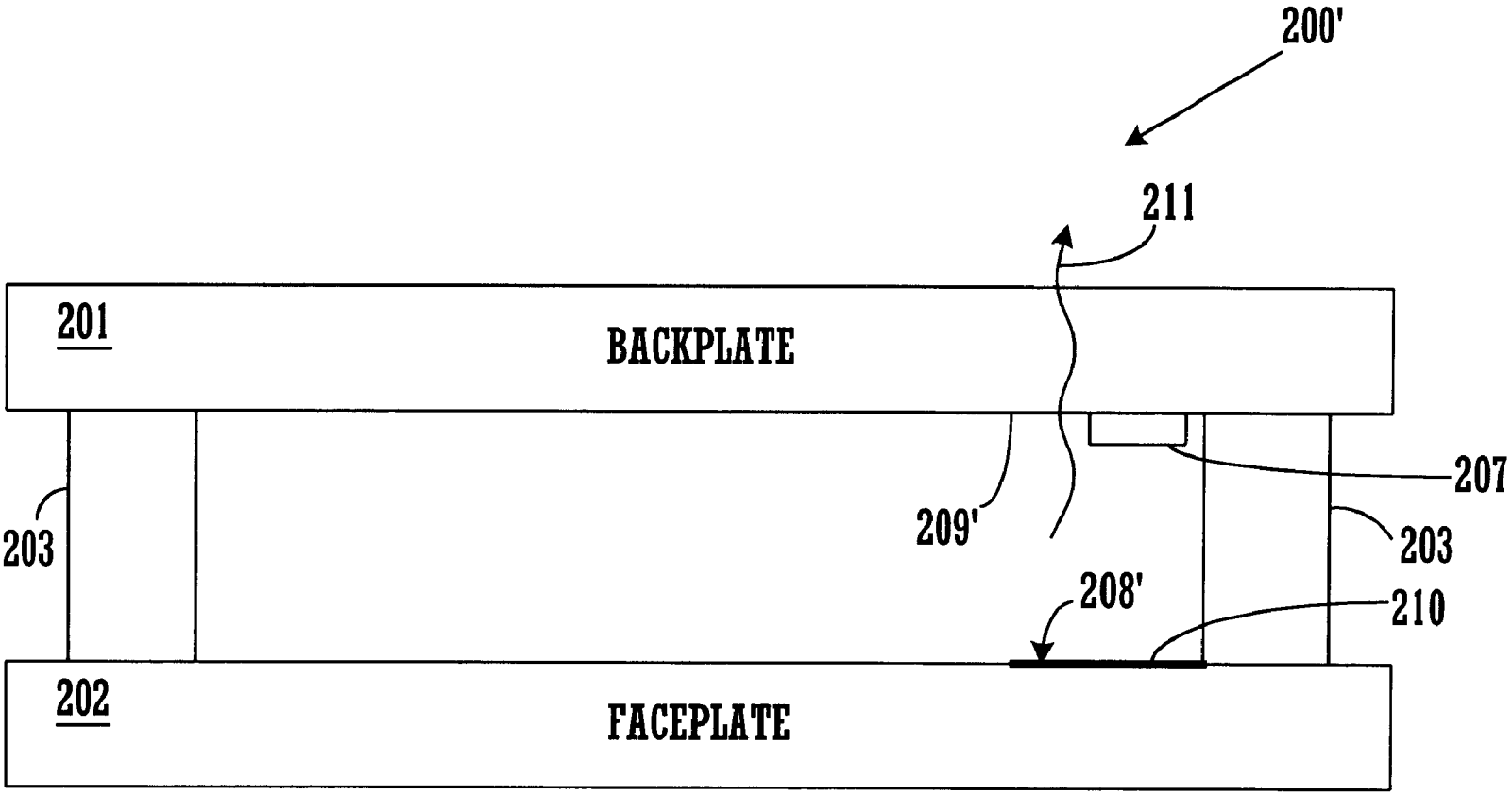
FIG. 20 is a side sectional view of a display device having a low emissivity surface and a high emissivity surface in accordance with one embodiment of the present claimed invention.

FIG. 20 shows an embodiment in which low emissivity surface 208' is located in the border region surrounding the active area of the display. Upon activation of getter 207, a film of getter material is deposited over low emissivity surface 208'. The heat generated by flashing getter 207 is conducted out of the display and away from low emissivity surface 208' through high emissivity surface 209'.

Referring to FIGS. 19–20, in one embodiment, getter 207 is a barium getter. Because the heat generated by flashing getter 207 is conducted out of the display and away from low emissivity surface 208, low emissivity surface 208 remains relatively cool. Because the surface onto which the barium film is to be deposited is relatively cool, the resulting barium film is porous and has good gettering properties.

Figure 21A:
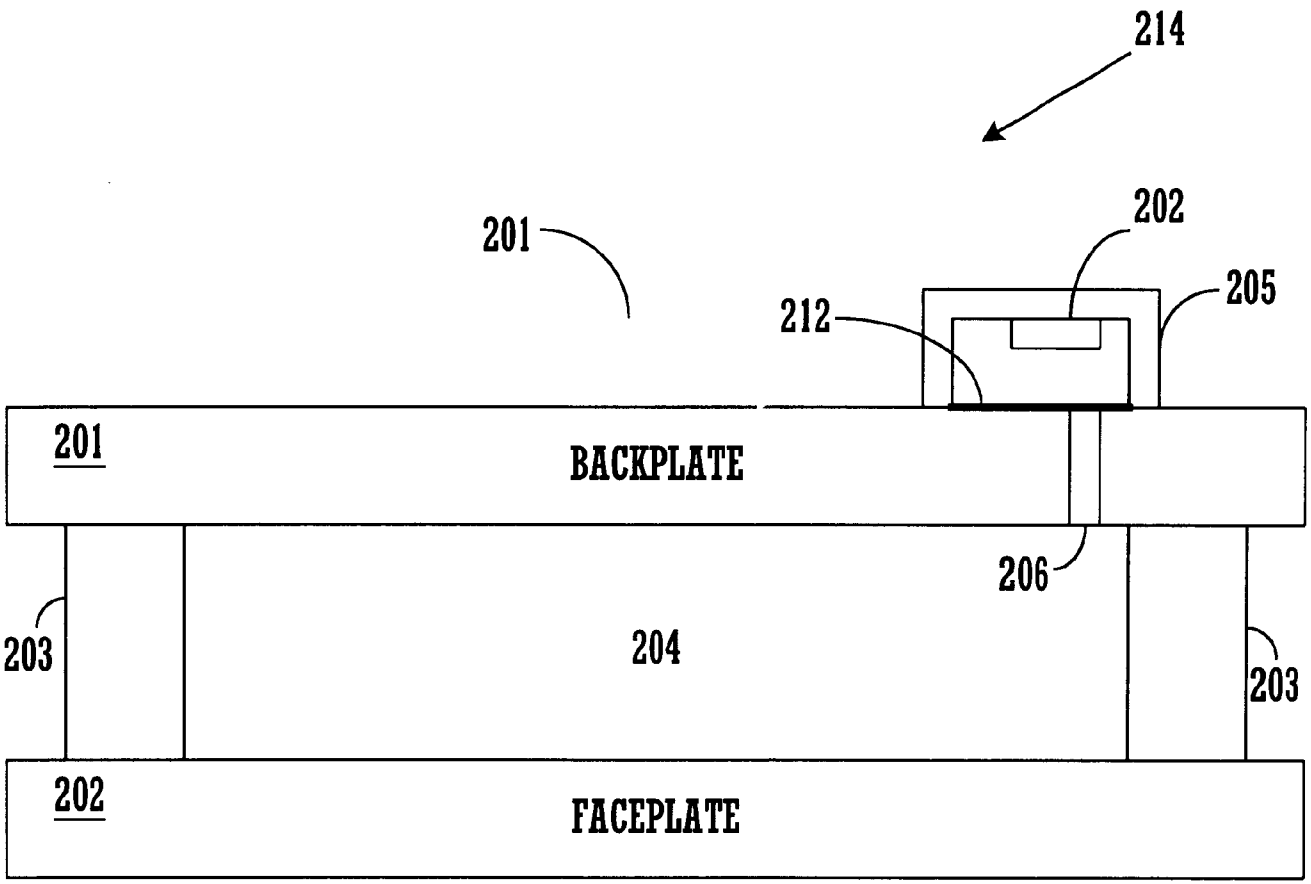
FIG. 21A is a side sectional view of a display device having an auxiliary chamber coupled thereto and having a carbon felt structure disposed within the auxiliary chamber in accordance with one embodiment of the present claimed invention.
Figure 21B:
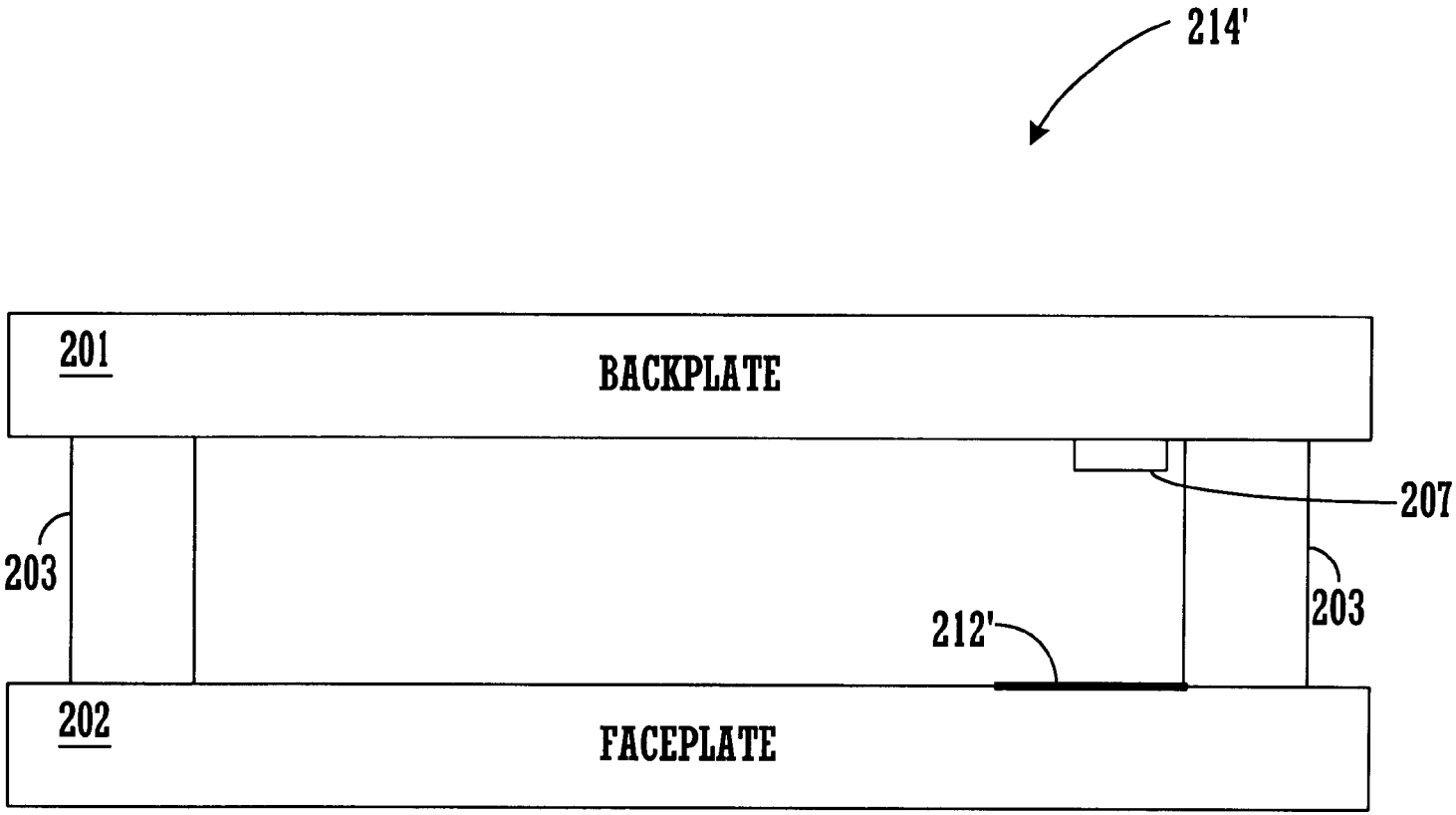
FIG. 21B is a side sectional view of a display device within which a carbon felt structure is disposed in accordance with one embodiment of the present claimed invention.

FIGS. 21A–21B, show an embodiment in which display device 214 and display device 214' include a large surface area structure 212. In the present embodiment, large surface area structure 212 is a carbon felt structure that is disposed near getter 207. In the present embodiment, getter 207 is a barium getter. Carbon felt structure 212 can be disposed in an auxiliary compartment 205 as is shown in FIG. 21A or can be disposed in the border region surrounding the active area of the display as shown by FIG. 21B. When getter 207 is flashed, a film of getter material is deposited on carbon felt structure 212. The carbon felt structure 212 provides a large surface area and is a high temperature, vacuum compatible material. Thus, the resulting film of getter material has a high surface area and good gettering ability. The use of carbon felt is particularly advantageous in the embodiment shown in FIG. 21B because the amount of space in the border region is limited.

Figure 22:
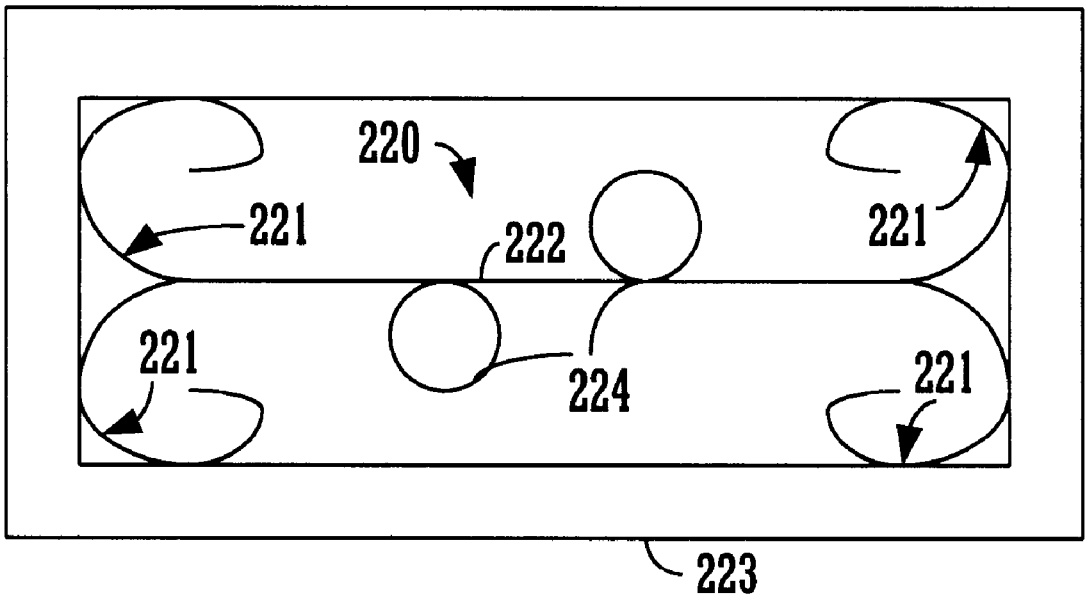
FIG. 22 is a top sectional view of an auxiliary chamber within which a support and two getters are disposed in accordance with one embodiment of the present claimed invention.

FIG. 22 shows a support 220 that includes extending members 221 extending from each side of support 220 near each end of support 220. In the present embodiment, support 220 is formed of wire that is spot welded. Extending members 221 are adapted to be pinched towards the body 222 of support 220 such that support 220 can be easily inserted into an auxiliary chamber 223. Once support 220 is properly positioned in auxiliary chamber 223, extending members 221 are allowed to expand such that they contact the side surfaces of auxiliary chamber 223. The tension provided by extending members 221 holds support 220 securely in place. Getters 224 are attached to support 220 such that getters 224 are suspended within auxiliary chamber 223. In one embodiment, getters 224 are barium getters. However, the present invention is well suited for use with getters 224 that are formed of other materials.

Referring still to FIG. 22, by suspending getters 224 within auxiliary chamber 223, getters 224 are isolated from tube and auxiliary compartment glass. The use of support 22 eliminates the need for using adhesive to attach a getter. The adhesive that is commonly used in the prior art for attaching a getter outgasses. Thus, the present invention eliminates outgassing associated with adhesive as commonly occurs in prior art getter assemblies. In addition, the time consuming adhesive cure operations of prior art getter assemblies is avoided by use of the present invention.

A non-evaporable getter (NEG) has a surface capacity that is much lower as compared to the bulk capacity of the NEG. The present invention provides for reactivation of the NEG once surface saturation occurs. By reactivating the NEG, the absorbed gasses are diffused into the bulk of the NEG, restoring the NEG's room temperature surface capacity. By reactivation of the NEG multiple times, the bulk capacity of the NEG is fully utilized.

In one embodiment, reactivation is performed by heating the NEG to a high temperature for a predetermined time period. The present embodiment uses a laser for reactivation. However, the present invention is well suited for use of other heating methods. In one embodiment, a single pass of a laser over the whole area of the getter is performed so as to heat the NEG to a temperature of approximately 900 degrees Centigrade for approximately 20 seconds. In one embodiment, the NEG is reactivated in intervals during the display burn-in and the initial life of the display, when outgassing level of the display components is still high. This reactivation can continue for the life of the display.

Figure 23A:
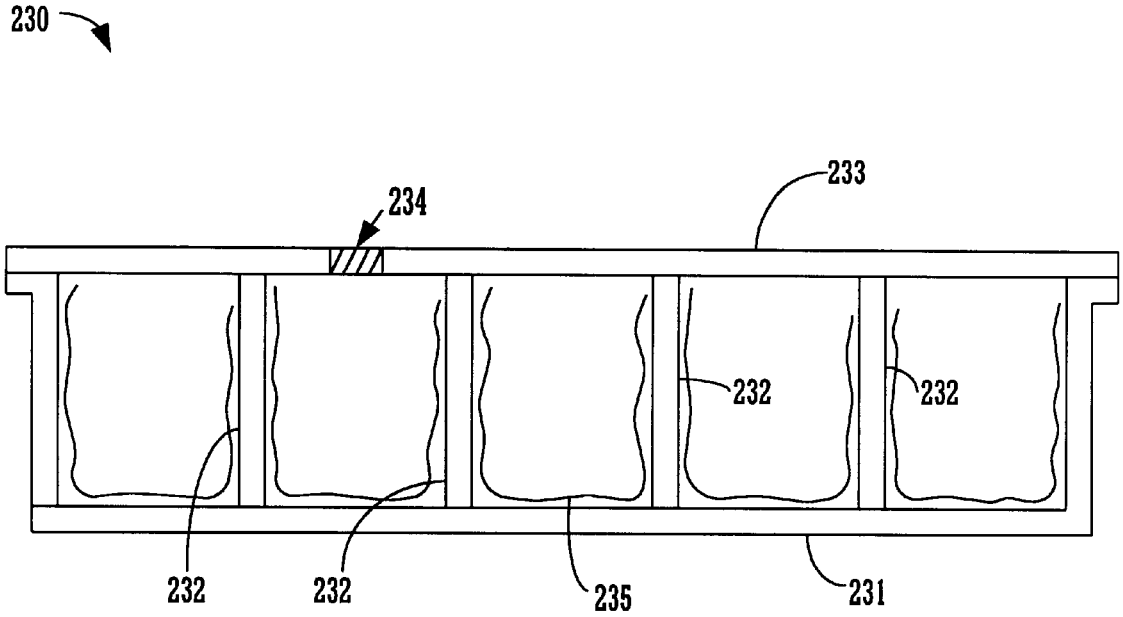
FIG. 23A is a side sectional view of a pre-flashed getter capsule in accordance with one embodiment of the present claimed invention.

Referring now to FIG. 23A, pre-flashed getter capsule 230 includes housing 231 within which support structures 232 extend. In one embodiment, support structures 232 are ribs. Alternatively, support structures 232 are posts. Cover 233 attaches to housing 231 so as to form an enclosure therebetween. In one embodiment, cover 223 is a thin metal plate. Within the enclosure, pre-flashed getter material 235 is a film that extends over the interior surfaces of housing 231 and extends over support structures 232. In one embodiment, housing 231 and support structures 232 are formed of metal. However, the present invention is well suited for use of a housing 231, support structures 232 and cover 233 that are formed of other materials such as, for example, glass. Thin plug 234 is formed within cover 233 and is adapted to be broken, melted or otherwise removed so as to expose the interior of pre-flashed getter capsule 230. However, the present invention is well suited for use of a cover that does not include a thin plug and which is adapted to be broken, melted or otherwise removed so as to expose the interior of pre-flashed getter capsule 230.

The pre-flashed getter capsule 230 of FIG. 23A can be formed by flashing a barium getter onto the inside of the housing 231 in a vacuum chamber. Preferably, the barium getter is flashed from a long distance. Cover 233 is then placed over housing 231 and is sealed to housing 231. The completed pre-flashed getter capsule is then removed from the vacuum chamber and is placed in an auxiliary chamber (not shown). Alternatively, the pre-flashed getter capsule 230 is placed in the border region surrounding the active areas of a display device.

Continuing with FIG. 23A, pre-flashed getter capsule 230 is activated by breaking, melting or otherwise removing thin plug 234 so as to expose the interior of pre-flashed getter capsule 230. In one embodiment the thin plug 234 is a low temperature plug that is broken by laser heating or radio frequency energy. The present invention is also well adapted for using a thin plug 234 that has metal antennas on it or that is coupled to a high thermal expansion piece of metal, crush-chambers, or by using a magnet to move an internal steel ball.

Figure 23B:
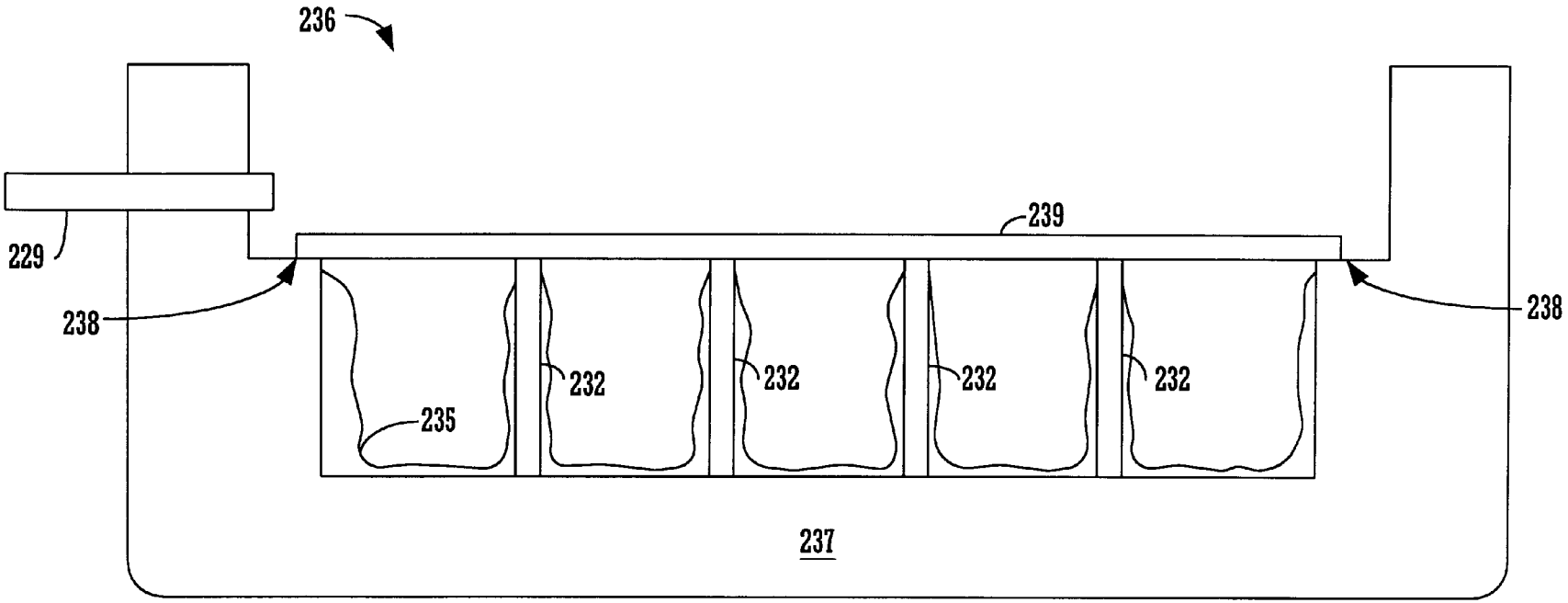
FIG. 23B is a side sectional view of a pre-flashed getter capsule formed within an auxiliary chamber in accordance with one embodiment of the present claimed invention.

FIG. 23B shows an embodiment in which a pre-flashed getter capsule 236 is formed within auxiliary chamber 237. Optionally, tubulation 229 is also disposed in auxiliary chamber 237. In the present embodiment, support structures 232 are formed within auxiliary chamber 237. Pre-flashed getter material 235 is disposed over the inner surface of auxiliary chamber 237 below ledge 238 such that pre-flashed getter material 235 overlies the interior surfaces of auxiliary chamber 237 and support structures 232. Cover 239 rests on ledge 238 so as to form a sealed enclosure. In the present embodiment, cover 239 is seal glass having a thickness of approximately 2 mils. However, the present invention is well suited for the use of covers formed of other materials. Also, the present invention is well suited for the use of thin plugs disposed within cover 239.

Figure 23C:
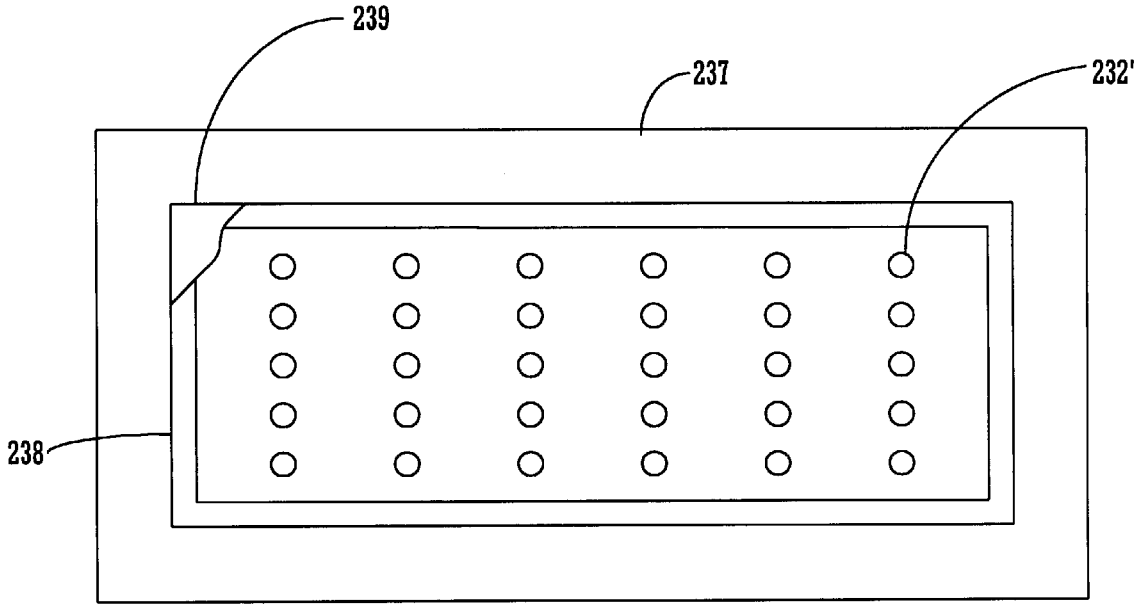
FIG. 23C is a top sectional view of a pre-flashed getter capsule formed within an auxiliary chamber that includes support structures that are posts in accordance with one embodiment of the present claimed invention.
Figure 23D:
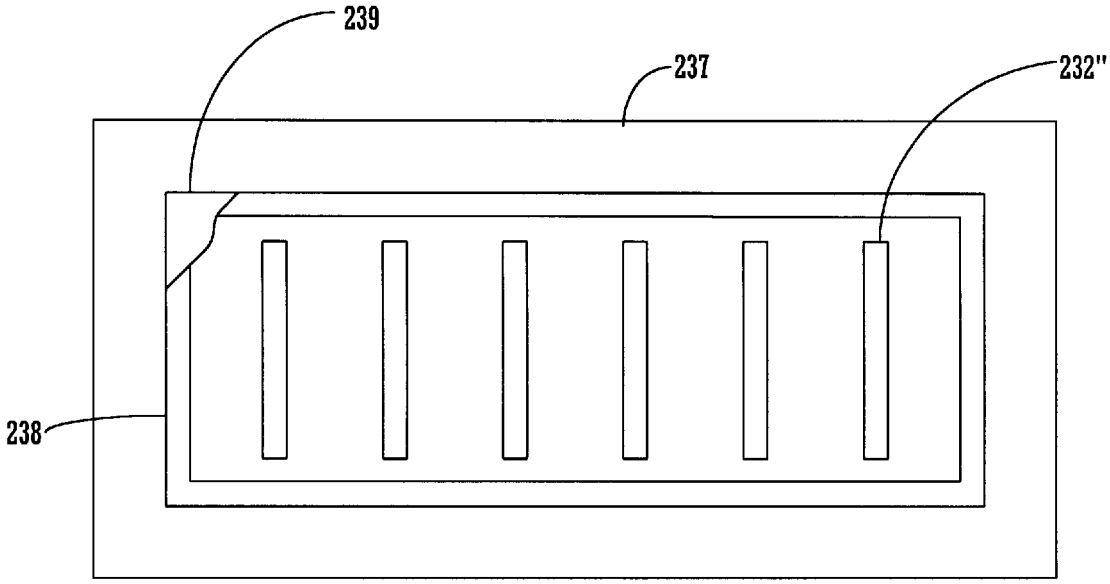
FIG. 23D is a top sectional view of a pre-flashed getter capsule formed within an auxiliary chamber that includes support structures that are ribs in accordance with one embodiment of the present claimed invention.

Continuing with FIG. 23B, though any of a number of different methods can be used for sealing cover 239 to auxiliary chamber 237, in the present embodiment, a glass frit seal is used. Support structures 232 can be posts 232' as shown in FIG. 23C or ribs 232" as shown in FIG. 23D. However, the present invention is also well suited to other shapes of support structure.

Referring still to FIG. 23B, activation is accomplished by breaking, melting or otherwise forming openings within cover 239. This exposes pre-flashed getter material 235. By flashing a getter in a vacuum environment, the flashing operation can be conducted under optimal conditions. This results in good quality pre-flashed getter material 235 that has good gettering abilities.

Figure 24:
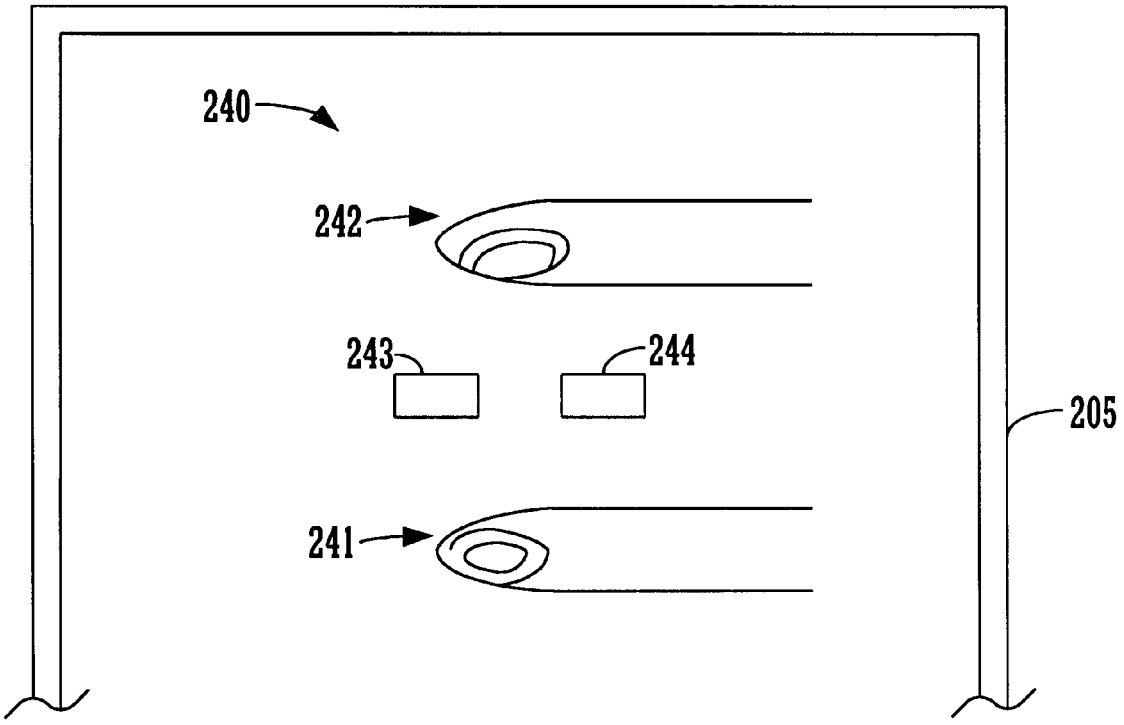
FIG. 24 is a schematic view of an assembly that includes RF coils and that is disposed in an auxiliary chamber in accordance with one embodiment of the present claimed invention.

Referring now to FIG. 24, an assembly 240 is shown that includes a lower Radio Frequency (RF) coil 241, an upper RF coil 242 and getters 243–244 that are disposed in auxiliary chamber 205. Alternatively, assembly 240 can be located within the border region of a display device or RF coils 241–242 can be placed outside of the auxiliary chamber. In one embodiment, RF coil 241 and RF coil 242 are phased array antennas that are positioned and phased such that, when lower RF coil 241 and upper RF coil 242 are energized, areas of constructive interference and areas of destructive interference result.

In one embodiment, getter 243 is in an area of constructive interference and getter 244 is in an area of destructive interference. This allows for the selective activation of getter 243 by generating RF radiation through upper RF coil 241 and lower RF coil 243. The remaining getter 244 can then be activated at a later time. In one embodiment, getter 243 is a barium getter and getter 244 is comprised of NEG material. This allows for selectively activating the barium getter 243 without activating the getter 244. In one embodiment, a laser or other heating means is used to activate getter 244 at a later time.

Figure 25:
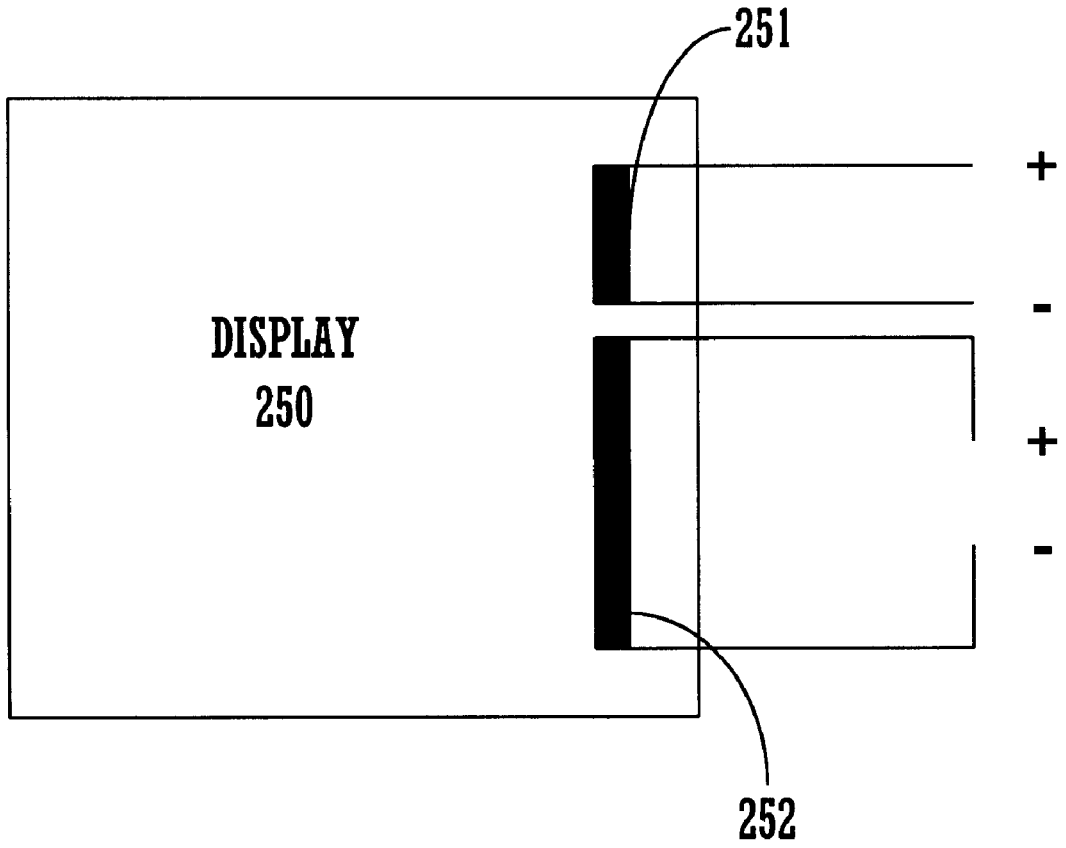
FIG. 25 is a schematic view of display having two getters disposed therein in accordance with one embodiment of the present claimed invention.

FIG. 25 shows an embodiment that includes Non-Evaporable getters 251 and 252 that are disposed inside of display 250. Both getter 251 and getter 252 are coupled to a power source (not shown) such that getter 251 and getter 252 can be selectively activated. In one embodiment, getter 251 is activated immediately prior to sealing the display, while the display is still hot and the components of the display have a high outgassing rate. Getter 251 remains at activation temperature (e.g. 500 degrees Centigrade) until the other parts of the display are cooled down to room temperature. This provides the maximum capacity for absorption of CO, $CO_2$ and $H_2O$. Referring still to FIG. 25, getter 252 can be activated later when the display is still in the factory. In one embodiment, getter 252 is activated by applying heat so as to heat getter 252 to a temperature of approximately 500 degrees Centigrade for approximately 10 minutes. The activation of getter 252 provides the necessary pressure inside the display over the lifetime of the display.

Figure 26A:
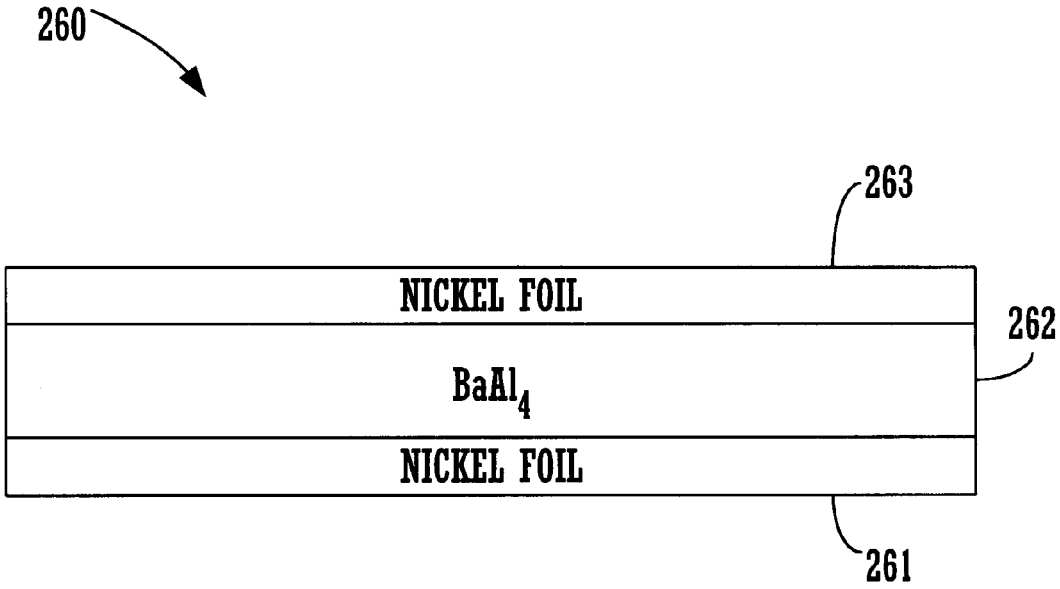
FIG. 26A is a side sectional view of a getter that includes barium aluminum in accordance with one embodiment of the present claimed invention.

Referring now to FIG. 26A, a planar evaporable getter 260 is shown that includes nickel foil layer 261 over which barium aluminum ($BaAl_4$) material 262 is disposed. Nickel foil layer 263 is disposed over barium aluminum layer 262.

Figure 26B:
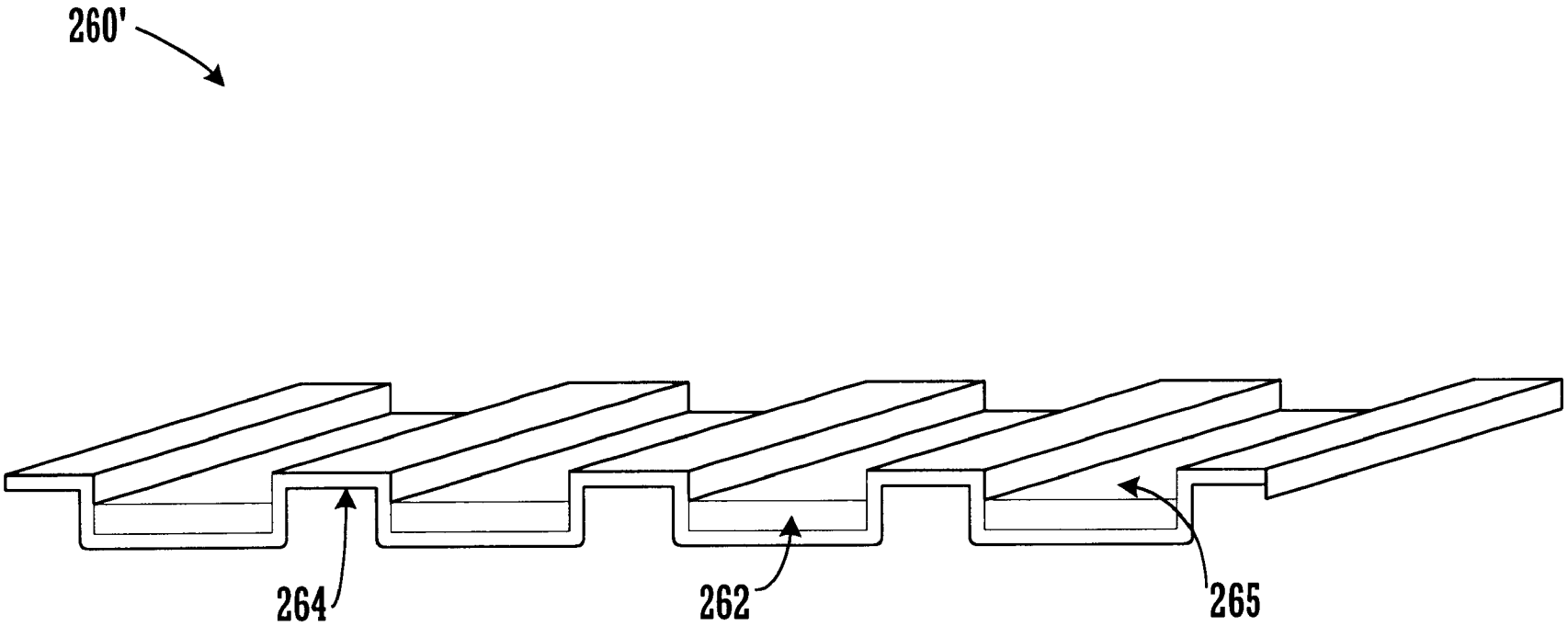
FIG. 26B is a perspective view of a getter that includes a nickel substrate having channels in accordance with one embodiment of the present claimed invention.

Referring now to FIG. 26B, an embodiment of a planar evaporable getter 260' is shown that includes formed nickel substrate 264. In the present embodiment, nickel substrate 264 is formed so as to produce a number of parallel channels within nickel substrate 264. Barium aluminum ($BaAl_4$) material 262 is disposed within each channel. Nickel film 265 is disposed such that it overlies barium aluminum material 262.

Figure 26C:
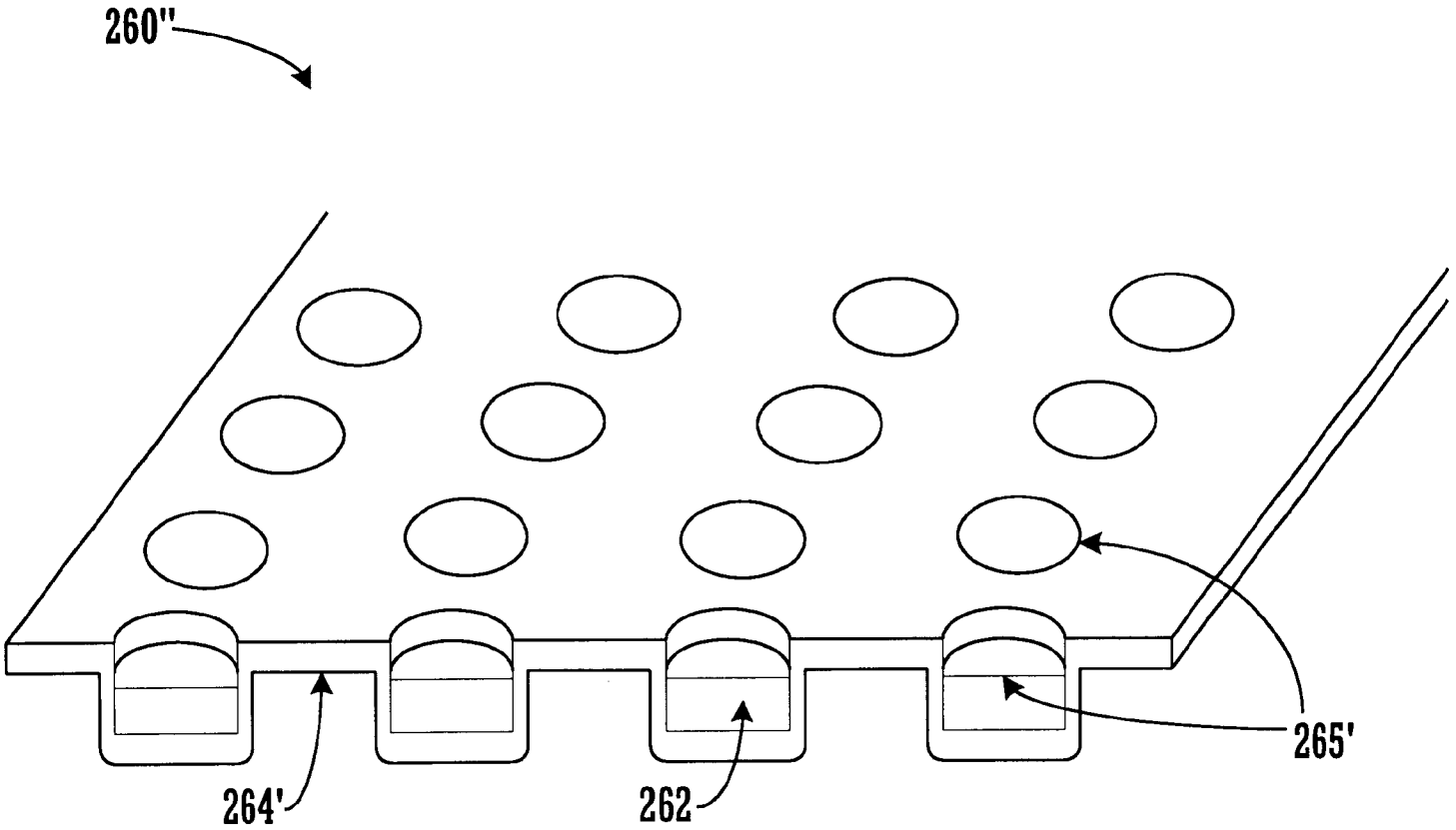
FIG. 26C is a perspective view of a getter that includes a nickel substrate having circular cavities in accordance with one embodiment of the present claimed invention.

In the embodiment shown in FIG. 26C, planar evaporable getter 260" includes nickel substrate 264' that has circular cavities. Barium aluminum material 262 is disposed within each circular cavity. Nickel film 265' overlies barium aluminum material 262. Though cavities are shown to be circular cavities, the present invention is well adapted for use of other shapes such as, for example, rectangular shapes, triangular shapes, etc.

In one embodiment, nickel substrate 264 and nickel substrate 264' are formed by pressing, electroforming, or otherwise shaping a nickel sheet. Barium aluminum material 262 is then deposited using a powder deposition process or by pressing barium aluminum material 262 into the sheet and wiping the surface with a doctor blade. In one embodiment, the cavities shown in FIGS. 26A–26C are in the range of 0.001 to 0.010 inches in width and 0.001 to 0.010 inches deep.

Figure 26D:
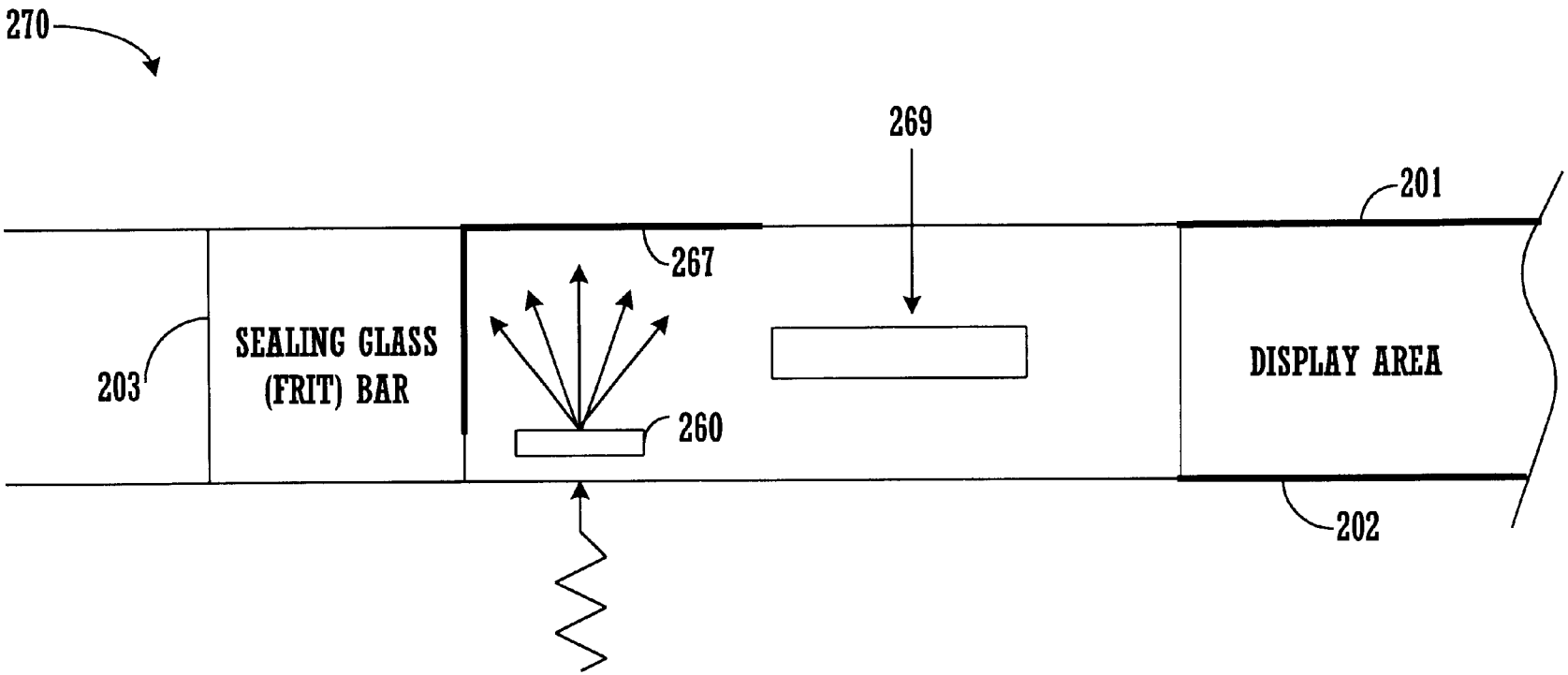
FIG. 26D is a side sectional view of a display within which two getters are disposed in accordance with one embodiment of the present claimed invention.

In the embodiment shown in FIG. 26D, a planar evaporable getter 260 is placed in a flat panel display 270. In the present embodiment, planar evaporable getter 260 of FIG. 26A, planar evaporable getter 260' of FIG. 26B or planar evaporable getter 260" of FIG. 26C is used. Upon optical irradiation (laser or infrared radiation) of planar evaporable getter 260, barium aluminum material 262 is flashed, forming a film of barium material 267. The exothermic reaction is $BaAl_4+4Ni \rightarrow Ba+4NiAl$. In addition, the present invention is well adapted for using materials other than barium such as, for example, lithium.

Figure 26E:
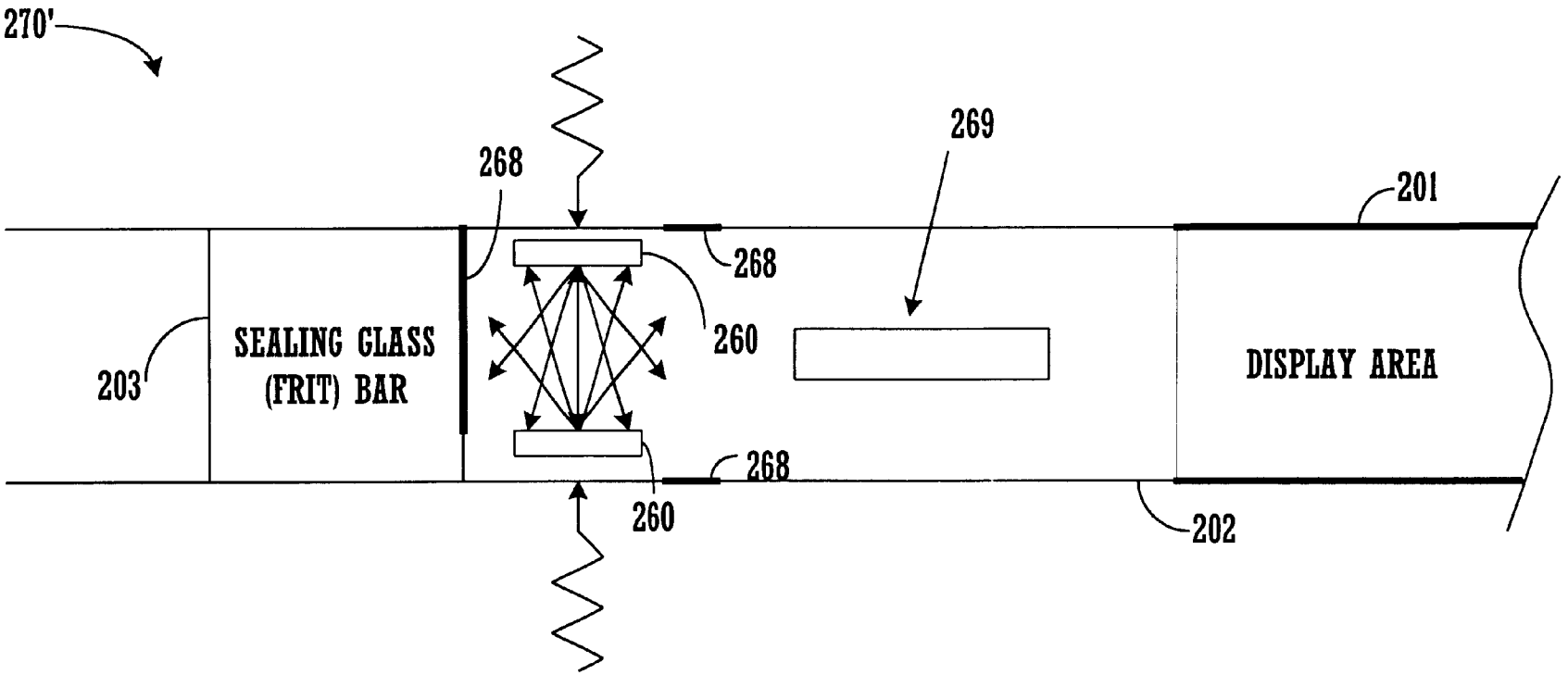
FIG. 26E is a side sectional view of a display within which three getters are disposed in accordance with one embodiment of the present claimed invention.

In the embodiment shown in FIG. 26E, two planar evaporable getters 260 are disposed opposite each other within flat panel display 270'. In the present embodiment, planar evaporable getter 260 of FIG. 26A, planar evaporable getter 260' of FIG. 26B or planar evaporable getter 260" of FIG. 26C is used. In the present embodiment, both planar evaporable getters 260 are activated at the same time, producing a film of barium material 268. By using two planar evaporable getters 260 that are located opposite each other, the resulting a film of barium material 268 is twice the size of film of barium material 267 of FIG. 26D.

The embodiments shown in FIGS. 26B and 26C allow for the sequential heating (flashing) of deposits of barium aluminum material 262. By sequentially heating deposits of barium aluminum material 262, a low deposition rate is obtained. This allows for the formation of renewable thin films of barium material 267 and 268. By sequentially heating the individual deposits of barium aluminum material 262, a thin film is incrementally deposited at a low deposition rate. This minimizes heating of the existing thin film (sintering) and prevents the associated reduced sorption capacity.

Referring still to FIGS. 26A–26E, in one embodiment, deposits of barium aluminum material 262 are sequentially activated during the initial life of the display to compensate for variable levels of outgassing during turn-on of the device. When used in conjunction with optional NEG 269, the optional NEG 269 can be routinely activated during the initial outgassing of the display components and the planar evaporable getter could be flashed to provide a very high capacity pumping at the time the display is shipped to the customer.

Thus, the present invention provides an apparatus that removes contaminants from a display device without compromising the usable amount of space available within the display device. The present invention also provides an auxiliary chamber that realizes the above listed accomplishment and which does not deleteriously expose features of the display device to getter material. The present invention further provides an auxiliary chamber which achieves the above-listed accomplishments but which does not significantly increase or alter the overall dimensions of the display device. The present invention also provides an apparatus with improved particle removal.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the Claims appended hereto and their equivalents.

What is claimed is:

1. An apparatus for removing contaminants from a display device comprising:

an auxiliary chamber, wherein said auxiliary chamber comprises metal, and is adapted to be coupled to a surface of a display device such that contaminants within said display device can travel from said display device into said auxiliary chamber; and a getter disposed within said auxiliary chamber, said getter adapted to capture said contaminants once said contaminants travel from said display device into said auxiliary chamber.

2. The apparatus of claim 1 for removing contaminants from a display device wherein said auxiliary chamber includes a cylindrical housing.

3. The apparatus of claim 2 for removing contaminants from a display device wherein said getter is non evaporable getter material.

4. The apparatus of claim 3 for removing contaminants from a display device wherein said getter includes a spiral of non evaporable getter material.

5. The apparatus of claim 2 for removing contaminants from a display device further including:

a conductive element disposed centrally within said cylindrical housing.

6. The apparatus of claim 1 for removing contaminants from a display device further including:

a power source coupled to said conductive element and coupled to said cylindrical housing, said power source adapted to provide electrical current for activating said getter.

7. The apparatus of claim 6 for removing contaminants from a display device further including:

tubulation coupled to said cylindrical housing, said tubulation adapted to be coupled to a vacuum source during evacuation of said cylindrical housing.

8. The apparatus of claim 7 for removing contaminants from a display device wherein said tubulation comprises a crimpable pump port.

9. The apparatus of claim 6 for removing contaminants from a display device wherein said auxiliary chamber is further adapted to be disposed above at least one hole extending through said surface of said display device such that said contaminants within said display device can travel from said display device through said holes and into said auxiliary chamber.

10. The apparatus of claim 1 for removing contaminants from a display device further including:

a high voltage feed-through; and a spring loaded contact coupled to said high voltage feed-through.

11. The apparatus of claim 1 for removing contaminants from a display device wherein said getter is disposed on a filament.

12. The apparatus of claim 11 for removing contaminants from a display device wherein said filament is configured in a lattice arrangement.

13. The apparatus of claim 11 for removing contaminants from a display device wherein said filament is configured in a bundled arrangement.

14. The apparatus of claim 1 for removing contaminants from a display device wherein said getter is disposed on a plurality of separate filaments located within said auxiliary chamber.

15. The apparatus of claim 1 for removing contaminants from a display device wherein said getter is evaporable getter.

16. The apparatus of claim 15 for removing contaminants from a display device wherein said evaporable getter includes barium.

17. The apparatus of claim 12 for removing contaminants from a display device wherein said getter comprises barium coated on said filament.

18. The apparatus of claim 17 for removing contaminants from a display device wherein said auxiliary chamber further comprises:

a bottom plate having openings disposed therethrough;

a housing disposed over said bottom plate so as to form an enclosure therebetween;

a first electrical feed-through extending through said housing and electrically coupled to said filament; and a second electrical feed-through extending through said housing and electrically coupled to said filament.

19. The apparatus of claim 18 for removing contaminants from a display device further comprising:

frit disposed on said bottom plate, said frit adapted to couple said auxiliary chamber to said surface of said display device.

20. The apparatus of claim 1 for removing contaminants from a display device further comprising:

a metal film selectively deposited within said auxiliary chamber, said metal film adapted to receive getter material upon activation of said getter.

21. The apparatus of claim 1 for removing contaminants from a display device further comprising:

a carbon felt structure adapted to receive getter material upon activation of said getter.

22. The apparatus of claim 1 for removing contaminants from a display device wherein said auxiliary chamber includes a plurality of side surfaces, said apparatus further comprising:

a support coupled to said getter, said support having a plurality of extending members extending therefrom, said plurality of extending members adapted to engage ones of said plurality of side surfaces of said auxiliary chamber such that said getter is suspended within said auxiliary chamber.

23. The apparatus of claim 1 for removing contaminants from a display device wherein said getter comprises non evaporative getter material, said getter activated for absorbing gasses and subsequently reactivated such that said absorbed gasses are diffused into said getter.

24. The apparatus of claim 1 for removing contaminants from a display device further comprising:

a housing;

a cover extending over said housing, said housing and said cover forming a sealed enclosure therebetween; and wherein said getter includes pre-flashed getter material disposed within said sealed enclosure.

25. The apparatus of claim 24 for removing contaminants from a display device further comprising:

a low temperature plug disposed in said cover and adapted to be melted.

26. The apparatus of claim 24 for removing contaminants from a display device further comprising:

a plug disposed in said cover, said plug having a plurality of antennas coupled thereto.

27. The apparatus of claim 24 for removing contaminants from a display device further comprising:

a plug disposed in said cover, said plug having a high thermal expansion piece of metal coupled thereto.

28. The apparatus of claim 24 for removing contaminants wherein said pre-flashed getter material comprises barium.

29. The apparatus of claim 1 for removing contaminants further comprising:

a cover disposed over a portion of said auxiliary chamber so as to form a sealed enclosure therewithin; and wherein said getter includes pre-flashed getter material disposed within said sealed enclosure.

30. The apparatus of claim 29 for removing contaminants wherein said pre-flashed getter material comprises barium.

31. The apparatus of claim 29 for removing contaminants from a display device wherein said cover comprises glass.

32. The apparatus of claim 29 for removing contaminants from a display device wherein said auxiliary chamber further includes a ledge adapted to receive said cover.

33. The apparatus of claim 1 for removing contaminants from a display device wherein said getter further comprises a first getter and a second getter, said apparatus further comprising:

a first coil disposed near said first getter and said second getter;

a second coil disposed near said first getter and said second getter, said first coil and said second coil adapted to be energized so as to radiate energy therebetween for selectively activating said first getter.

34. The apparatus of claim 33 for removing contaminants from a display device wherein said first getter comprises a barium getter and wherein said second getter comprises a non evaporable getter.

35. The apparatus of claim 1 for removing contaminants from a display device wherein said getter comprises a first getter and a second getter, said first getter and said second getter coupled to a power source such that said first getter and said second getter can be selectively activated.

36. The apparatus of claim 1 for removing contaminants from a display device wherein said getter is activated using a laser.

37. The apparatus of claim 1 for removing contaminants from a display device wherein said getter further comprises:

a first foil layer;

a layer of barium aluminum material; and a second foil layer disposed over said barium aluminum layer.

38. The apparatus of claim 1 for removing contaminants from a display device wherein said getter further comprises:

a substrate having a plurality of channels formed therewithin;

evaporable getter material disposed within said plurality of channels; and a film disposed over said evaporable getter material.

39. The apparatus of claim 1 for removing contaminants from a display device wherein said getter further comprises:

a substrate having a plurality of cavities formed therewithin;

barium aluminum material disposed within said plurality of cavities; and a film disposed over said barium aluminum material.

40. The apparatus of claim 39 for removing contaminants from a display device wherein said cavities are circular.

41. The apparatus of claim 39 for removing contaminants from a display device wherein said cavities are rectangular.

42. An apparatus for removing contaminants from a display device comprising:

a housing;

a cover extending over said housing, said housing and said cover forming a sealed enclosure therebetween;

pre-flashed getter material disposed within said sealed enclosure; and a low temperature plug disposed within said cover and adapted to be melted.

43. An apparatus for removing contaminants from a display device comprising:

a housing;

a cover extending over said housing, said housing and said cover forming a sealed enclosure therebetween;

pre-flashed getter material disposed within said sealed enclosure; and a plug having a plurality of antennas coupled thereto.

44. An apparatus for removing contaminants from a display device comprising:

a housing;

a cover extending over said housing, said housing and said cover forming a sealed enclosure therebetween;

pre-flashed getter material disposed within said sealed enclosure; and a plug having a high thermal expansion piece of metal coupled thereto.

45. The apparatus of claim 42 for removing contaminants wherein said pre-flashed getter material comprises barium.

46. The apparatus of claim 42 for removing contaminants wherein said cover comprises glass.

47. An apparatus for removing contaminants from a display device that includes a faceplate and a backplate that are coupled together so as to form an enclosure therebetween, said apparatus comprising:

a first getter;

a second getter;

a first coil disposed near said first getter and said second getter; and a second coil disposed near said first getter and said second getter, said first coil and said second coil adapted to be energized so as to radiate energy therebetween for selectively activating said first getter.

48. The apparatus of claim 47 for removing contaminants from a display device wherein said first getter comprises a barium getter and wherein said second getter comprises a non evaporable getter.

49. An apparatus for removing contaminants from a display device comprising:

an auxiliary chamber adapted to be coupled to a surface of a display device such that contaminants within said display device can travel from said display device into said auxiliary chamber;

a getter configured in a lattice arrangement and disposed on a barium-coated filament within said auxiliary chamber, said getter adapted to capture said contaminants once said contaminants travel from said display device into said auxiliary chamber;

a bottom plate having openings disposed therethrough;

a housing disposed over said bottom plate so as to form an enclosure therebetween;

a first electrical feed-through extending through said housing and electrically coupled to said filament; and a second electrical feed-through extending through said housing and electrically coupled to said filament.

50. The apparatus of claim 49 for removing contaminants from a display device further comprising:

frit disposed on said bottom plate, said frit adapted to couple said auxiliary chamber to said surface of said display device.

51. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber; and a metal film selectively deposited within said auxiliary chamber, said metal film adapted to receive getter material upon activation of said getter.

52. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber; and a carbon felt structure adapted to receive getter material upon activation of said getter.

53. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber;

a housing;

a cover extending over said housing, said housing and said cover forming a sealed enclosure therebetween;

wherein said getter includes pre-flashed getter material disposed within said sealed enclosure; and a low temperature plug disposed in said cover and adapted to be melted.

54. The apparatus of claim 53 for removing contaminants from a display device further comprising:

a plug disposed in said cover, said plug having a plurality of antennas coupled thereto.

55. The apparatus of claim 53 for removing contaminants from a display device further comprising:

a plug disposed in said cover, said plug having a high thermal expansion piece of metal coupled thereto.

56. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber;

a first coil disposed near said first getter and said second getter; and a second coil disposed near said first getter and said second getter, said first coil and said second coil adapted to be energized so as to radiate energy therebetween for selectively activating said first getter.

57. The apparatus of claim 56 for removing contaminants from a display device wherein said first getter comprises a barium getter and wherein said second getter comprises a non evaporable getter.

58. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber; and wherein said getter comprises a first getter and a second getter, said first getter and said second getter coupled to a power source such that said first getter and said second getter can be selectively activated.

59. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber;

a first foil layer;

a layer of barium aluminum material; and a second foil layer disposed over said barium aluminum layer.

60. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber;

a substrate having a plurality of channels formed therewithin;

evaporable getter material disposed within said plurality of channels; and a film disposed over said evaporable getter material.

61. An apparatus for removing contaminants from a display device comprising:

an auxiliary chamber adapted to be coupled to a surface of a display device such that contaminants within said display device can travel from said display device into said auxiliary chamber;

a getter disposed within said auxiliary chamber, said getter adapted to capture said contaminants once said contaminants travel from said display device into said auxiliary chamber;

a substrate having a plurality of cavities formed therewithin;

barium aluminum material disposed within said plurality of cavities; and a film disposed over said barium aluminum material.

62. The apparatus of claim 61 for removing contaminants from a display device wherein said cavities are circular.

63. The apparatus of claim 61 for removing contaminants from a display device wherein said cavities are rectangular.

* * * * *